US007874174B2

(12) United States Patent
Yabu et al.

(10) Patent No.: US 7,874,174 B2
(45) Date of Patent: Jan. 25, 2011

(54) HUMIDITY CONTROL SYSTEM

(75) Inventors: Tomohiro Yabu, Osaka (JP); Eisaku Okubo, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 700 days.

(21) Appl. No.: 11/887,248

(22) PCT Filed: Mar. 20, 2006

(86) PCT No.: PCT/JP2006/305506

§ 371 (c)(1),
(2), (4) Date: Sep. 27, 2007

(87) PCT Pub. No.: WO2006/103968

PCT Pub. Date: Oct. 5, 2006

(65) Prior Publication Data

US 2009/0288444 A1 Nov. 26, 2009

(30) Foreign Application Priority Data

Mar. 29, 2005 (JP) ..... 2005-094925

(51) Int. Cl.
*F25B 23/00* (2006.01)

(52) U.S. Cl. ..... 62/271; 62/476

(58) Field of Classification Search ..... 62/91, 62/92, 93, 94, 271, 476, 477
See application file for complete search history.

(56) References Cited

U.S. PATENT DOCUMENTS 4,467,785 A * 8/1984 Langford et al. ..... 126/400
5,158,582 A * 10/1992 Onitsuka et al. ..... 95/129
5,212,956 A * 5/1993 Tsimerman ..... 62/94

(Continued)

FOREIGN PATENT DOCUMENTS

JP 8-94124 A 4/1996

(Continued)

OTHER PUBLICATIONS

Translation to an IDS enclosed by the Applicant of JP 2002-228208 A to Hashimoto et al.*

*Primary Examiner*—Mohammad M Ali
(74) *Attorney, Agent, or Firm*—Birch, Stewart, Kolasch & Birch, LLP.

(57) ABSTRACT

A humidity control system during humidification operation sequentially repeats a first mode in which a second adsorption heat exchanger (82) serves as an evaporator and the remaining adsorption heat exchangers serve as evaporators, a second mode in which a third adsorption heat exchanger (83) serves as an evaporator and the remaining adsorption heat exchangers serve as evaporators and a third mode in which a first adsorption heat exchanger (81) serves as an evaporator and the remaining adsorption heat exchangers serve as evaporators. For example, during the first mode, the first adsorption heat exchanger (81) serving as an evaporator adsorbs moisture in a first air. Furthermore, in the second adsorption heat exchanger (82) serving as a condenser, the adsorbent is regenerated to humidify a second air. Furthermore, in the third adsorption heat exchanger (83) serving as an evaporator, the second air given moisture and heat in the second adsorption heat exchanger (82) is cooled. The humidity control system supplies the second air humidified by the second adsorption heat exchanger (82) and cooled by the third adsorption heat exchanger (83) to a room.

6 Claims, 15 Drawing Sheets

U.S. PATENT DOCUMENTS

| | | | | |
|---|---|---|---|---|
| 5,251,458 | A * | 10/1993 | Tchernev | 62/271 |
| 5,635,142 | A * | 6/1997 | Ichiki et al. | 422/177 |
| 5,667,560 | A * | 9/1997 | Dunne | 95/113 |
| 5,775,126 | A * | 7/1998 | Sato et al. | 62/480 |
| 6,959,875 | B2 * | 11/2005 | Yabu et al. | 236/44 C |
| 6,978,635 | B2 * | 12/2005 | Yabu et al. | 62/271 |
| 7,029,518 | B2 * | 4/2006 | Fujii et al. | 95/117 |
| 7,160,367 | B2 * | 1/2007 | Babicki et al. | 96/116 |
| 7,217,313 | B2 * | 5/2007 | Motono et al. | 95/113 |
| 2001/0009124 | A1 * | 7/2001 | Suzuki et al. | 95/113 |
| 2001/0045161 | A1 * | 11/2001 | McMahon | 95/116 |
| 2004/0261618 | A1 * | 12/2004 | Babicki et al. | 95/113 |
| 2005/0178267 | A1 * | 8/2005 | Fujii et al. | 95/90 |

FOREIGN PATENT DOCUMENTS

| | | | |
|---|---|---|---|
| JP | 2001-96126 | A | 4/2001 |
| JP | 2002-206776 | A | 7/2002 |
| JP | 2002-228208 | A | 8/2002 |
| JP | 2003-161465 | A | 6/2003 |
| JP | 2004-60954 | A | 2/2004 |
| JP | 2004-353887 | A | 12/2004 |

* cited by examiner

HUMIDITY CONTROL SYSTEM

TECHNICAL FIELD

This invention relates to humidity control systems for controlling air humidity using an adsorbent.

BACKGROUND ART

Humidity control systems for controlling air humidity using an adsorbent are conventionally known.

For example, Patent Document 1 discloses a rotor type humidity control system for supplying humidified air to a room. In the rotor type humidity control system, an adsorption rotor carrying an adsorbent is disposed across both an adsorption zone and a regeneration zone. A part of the adsorption rotor having adsorbed moisture in the air in the adsorption zone moves to the regeneration zone with the rotation of the adsorption rotor. In the regeneration zone, air heated as by an electric heater passes through the adsorption rotor and, during the passage, the air is humidified by moisture desorbed from the adsorption rotor. Then, the air humidified in the regeneration zone is supplied to the room.

Patent Document 2 discloses a batch type humidity control system using a plurality of adsorption heat exchangers in each of which an adsorbent is carried on the surface thereof in contact with air. In the batch type humidity control system, the adsorption heat exchangers are connected in a refrigerant circuit for operating in a refrigeration cycle, air is humidified by moisture desorbed from the adsorption heat exchanger serving as a condenser and moisture in the air is adsorbed on the adsorption heat exchanger serving as an evaporator. The humidity control system continuously performs air dehumidification and humidification by reversing the direction of refrigerant circulation in the refrigerant circuit to alternately change the function of each adsorption heat exchanger from a condenser to an evaporator or vice versa. Furthermore, the humidity control system is capable of an operation of supplying humidified air into a room.

Patent Document 1: Published Japanese Patent Application No. 2001-096126

Patent Document 2: Published Japanese Patent Application No. 2004-353887

DISCLOSURE OF THE INVENTION

Problem to be Solved by the Invention

As described above, the known humidity control systems using an adsorbent humidify air using moisture desorbed from their adsorbents by heat. This increases not only the amount of moisture in the air to be humidified but also the temperature or the air. Therefore, if the known humidity control systems are used when it is necessary to increase only the humidity of the room air and avoid the increase in the temperature thereof to the greatest extent, such as when humidifying the interior of a cold storage, the air increased in not only the amount of moisture therein but also the temperature will be supplied to the room. This might increase the cooling load of the room.

The present invention has been made in view of the above and, therefore, its object is to restrain the increase in the temperature of air humidified by the humidity control system.

Means to Solve the Problem

A first aspect of the invention is directed to a humidity control system comprising a plurality of adsorption elements (81, 82, 83) allowing respective adsorbents carried on the respective surfaces thereof to come into contact with air and a regenerator (70) for regenerating the adsorbents of the adsorption elements (81, 82, 83) by heating, the humidity control system being configured to allow each said adsorption element (81, 82, 83) to repeatedly perform an adsorption action of adsorbing moisture in a first air on the associated adsorbent and a regeneration action of regenerating the adsorbent with the regenerator (70) to humidify a second air, and the humidity control system being capable of a humidification operation of supplying the humidified second air to a room and exhausting the dehumidified first air to the outside. Furthermore, the humidity control system performs, during the humidification operation, a cooling action of cooling the second air humidified by one said adsorption element performing the regeneration action by allowing the second air to pass through another said adsorption element having already performed the previous adsorption action but having not yet performed the next regeneration action.

According to the first aspect, the humidity control system (10) during the humidification operation performs an adsorption action, a regeneration action and a cooling action. In the adsorption element intended for the adsorption action, moisture in the first air is gradually adsorbed on the adsorbent. In the adsorption element intended for the regeneration action, the adsorbent having adsorbed moisture during the adsorption action is heated by the action of the regenerator (70) to gradually desorb moisture from it. The second air is humidified during passage through the adsorption element intended for the regeneration action. In addition, in the adsorption element intended for the regeneration action, the adsorbent is heated, whereby the second air raises its temperature during passage through the adsorption element.

In the first aspect, the cooling action is performed for the adsorption element having already adsorbed much moisture when performing the adsorption action. Sent to the adsorption element intended for the cooling action is the second air given moisture and heat during passage through another adsorption element intended for the regeneration action. The adsorption element intended for the cooling action has a lower temperature than the adsorption element intended for the regeneration action. Therefore, the second air having passed through the adsorption element intended for the regeneration action releases heat during passage through the adsorption element intended for the cooling action. During the heat release, the adsorption element intended for the cooling action has already adsorbed a relatively large amount of moisture. Therefore, the amount of moisture in the second air is little reduced or not reduced during passage through the adsorption element intended for the cooling action.

A second aspect of the invention is directed to a humidity control system. The humidity control system comprises first, second and third adsorption elements (81, 82, 83) allowing respective adsorbents carried on the respective surfaces thereof to come into contact with air and a regenerator (70) for regenerating the adsorbents of the adsorption elements (81, 82, 83) by heating, is configured to sequentially repeat: a first mode in which moisture in a first air is adsorbed on the first adsorption element (81) and a second air humidified by the second adsorption element (82) being regenerated by the regenerator (70) is cooled by the third adsorption element (83); a second mode in which moisture in the first air is adsorbed on the second adsorption element (82) and the second air humidified by the third adsorption element (83) being regenerated by the regenerator (70) is cooled by the first adsorption element (81); and a third mode in which moisture in the first air is adsorbed on the third adsorption element (83) and the second air humidified by the first adsorption element (81) being regenerated by the regenerator (70) is cooled by the second adsorption element (82), and is capable of a humidification operation of supplying the humidified and cooled second air to a room and exhausting the dehumidified first air to the outside.

According to the second aspect, the humidity control system (10) during the humidification operation sequentially repeats a first mode, a second mode and a third mode. In other words, in the humidity control system (10) during the humidification operation, the second mode is started upon completion of the first mode, the third mode is started upon completion of the second mode and the first mode is started upon completion of the third mode.

In each mode of the second aspect, the adsorption element regenerated by the regenerator (70) in the immediately preceding mode adsorbs moisture in the first air, the adsorption element used to cool the second air in the immediately preceding mode is regenerated by the regenerator (70) and the adsorption element having adsorbed moisture in the first air in the immediately preceding mode is used to cool the humidified second air. In the adsorption element whose adsorbent is heated by the regenerator (70) in the current mode, heat is applied, together with moisture desorbed from the adsorbent, to the second air passing through the adsorption element. The adsorption element having adsorbed moisture in the first air in the immediately preceding mode has a lower temperature than the adsorption element whose adsorbent is heated by the regenerator (70) in the current mode. Therefore, the second air given moisture and heat by the adsorption element being regenerated by the regenerator (70) releases heat during passage through the adsorption element having adsorbed moisture in the first air in the immediately preceding mode. During the heat release, the adsorption element having adsorbed moisture in the first air in the immediately preceding mode has already adsorbed a relatively large amount of moisture. Therefore, the amount of moisture in the second air is little reduced or not reduced during passage through the adsorption element.

A third aspect of the invention is directed to the second aspect, wherein adsorption heat exchangers (81, 82, 83) allowing heat exchange of air passing therethrough with a heat transfer medium and carrying adsorbents on the surfaces thereof in contact with the air are provided as the adsorption elements, and a heat transfer medium circuit (70) for supplying the heat transfer medium for heating to the second adsorption heat exchanger (82) in the first mode, the third adsorption heat exchanger (83) in the second mode and the first adsorption heat exchanger (81) in the third mode is provided as the regenerator.

According to the third aspect, air passing through the adsorption heat exchanger (81, 82, 83) exchanges heat with the heat transfer medium upon contact with the adsorbent. In the adsorption heat exchanger (81, 82, 83) to which the heat transfer medium circuit (70) supplies the heat transfer medium for heating it, the adsorbent carried on the surface is heated by the heat transfer medium for heating, so that moisture desorbed from the heated adsorbent is applied to the second air. Furthermore, in the same adsorption heat exchanger (81, 82, 83), the second air is heated by heat exchange with the heat transfer medium for heating.

A fourth aspect of the invention is directed to the third aspect, wherein the heat transfer medium circuit (70) is configured to supply the heat transfer medium for cooling to the first and third adsorption heat exchangers (81, 83) in the first mode, the first and second adsorption heat exchangers (81, 82) in the second mode and the second and third adsorption heat exchangers (82, 83) in the third mode.

According to the fourth aspect, the heat transfer medium circuit (70) supplies the heat transfer medium for heating to one of the three adsorption heat exchangers (81, 82, 83) and the heat transfer medium for cooling to the remaining two adsorption heat exchangers. Out of the two adsorption heat exchangers to which the heat transfer medium for cooling is supplied, one adsorbs moisture in the first air and the other cools the humidified second air. In the one adsorption heat exchanger adsorbing moisture in the first air, heat of adsorption produced therein is taken by the heat transfer medium for cooling. In the other adsorption heat exchanger cooling the humidified second air, heat of the second air is taken by the heat transfer medium for cooling. During the cooling, the other adsorption heat exchanger has already adsorbed a relatively large amount of moisture. Therefore, the amount of moisture in the second air is little reduced or not reduced.

A fifth aspect of the invention is directed to the fourth aspect, wherein the heat transfer medium circuit (70) includes a compressor (71) and an expansion mechanism (72, 73, 74) and is configured to operate in a refrigeration cycle by circulating refrigerant as the heat transfer medium therethrough and supply the refrigerant of high pressure discharged from the compressor (71) as the heat transfer medium for heating and the refrigerant of low pressure having passed through the expansion mechanism (72, 73, 74) as the heat transfer medium for cooling to the associated adsorption heat exchangers (81, 82, 83).

According to the fifth aspect, the heat transfer medium circuit (70) is configured to operate in a refrigeration cycle. In the adsorption heat exchanger (81, 82, 83) to which refrigerant of high pressure discharged from the compressor (71) is supplied as the heat transfer medium for heating, the supplied high-pressure refrigerant releases heat to the adsorbent or the second air to condense itself. On the other hand, in the adsorption heat exchanger (81, 82, 83) to which refrigerant of low pressure having passed through the expansion mechanism (72, 73, 74) is supplied as the heat transfer medium for cooling, the supplied low-pressure refrigerant takes heat from the adsorbent, the first air or the humidified second air to evaporate itself.

A sixth aspect of the invention is directed to a humidity control system. The humidity control system comprises: an adsorption side passage (91) through which a first air to be dehumidified flows; a regeneration side passage (92) through which a second air to be humidified flows; a cooling side passage (93) which continues to the terminal end of the regeneration side passage (92) and through which the second air flows; an adsorption element (90) disposed across the adsorption side passage (91), the regeneration side passage (92) and the cooling side passage (93) and allowing an adsorbent carried on the surface thereof to come into contact with air; and a regenerator (94) for regenerating the adsorbent in a part of the adsorption element (90) going across the regeneration side passage (92) by heating, and is capable of a humidification operation of moving the adsorption element (90) so that a part of the adsorption element (90) going across the adsorption side passage (91) sequentially goes across the cooling side passage (93) and the regeneration side passage (92) and then returns to the adsorption side passage (91), supplying the second air humidified during passage through the adsorption element (90) in the regeneration side passage (92) and then cooled during passage through the adsorption element (90) in the cooling side passage (93) to a room, and exhausting the first air dehumidified during passage through the adsorption element (90) in the adsorption side passage (91) to the outside.

According to the sixth aspect, with reference to a part of the adsorption element (90), the part goes across the adsorption side passage (91), the cooling side passage (93) and the regeneration side passage (92) in this order and then returns to the adsorption side passage (91). In a part of the adsorption element (90) going across the regeneration side passage (92), the adsorbent is heated by the regenerator (94) and thereby regenerated. During the regeneration, the second air flowing through the regeneration side passage (92) is given heat together with moisture desorbed from the adsorbent during passage through the adsorption element (90). The part of the adsorption element (90) regenerated while going across the regeneration side passage (92) moves to the adsorption side passage (91). In the part of the adsorption element (90) going across the adsorption side passage (91), moisture in the first air is gradually adsorbed on the adsorbent.

In the sixth aspect, the part of the adsorption element (90) having adsorbed moisture while having gone across the adsorption side passage (91) moves to the cooling side passage (93). The part of the adsorption element (90) moving to the cooling side passage (93) has a lower temperature than the part of the adsorption element (90) being regenerated while going across the regeneration side passage (92). The second air given moisture and heat during passage through the adsorption element (90) in the regeneration side passage (92) releases heat during passage through the adsorption element (90) after flowing into the cooling side passage (93). During the heat release, the part of the adsorption element (90) moving to the cooling side passage (93) has already adsorbed a relatively large amount of moisture while having gone across the adsorption side passage (91). Therefore, the amount of moisture in the second air is little reduced or not reduced during passage through the part of the adsorption element (90) going across the cooling side passage (93).

EFFECTS OF THE INVENTION

According to the first and second aspects, the second air given moisture and heat in the adsorption element being regenerated by the regenerator (70) is sent to the adsorption element whose adsorbent has already adsorbed a relatively large amount of moisture. Therefore, according to these aspects, by using the adsorption element (81, 82, 83) having already adsorbed moisture, only heat can be taken from the second air given moisture and heat. According to the sixth aspect, the second air given moisture and heat in the part of the adsorption element (90) being regenerated by the regenerator (94) is sent to the part of the adsorption element (90) in which the adsorbent has already adsorbed a relatively large amount of moisture. Therefore, according to this aspect, by using the part of the adsorption element (90) having already adsorbed moisture, only heat can be taken from the second air given moisture and heat.

Therefore, according to the invention, the temperature of the second air supplied to the room by the humidity control system (10) during the humidification operation can be reduced as compared with the conventional cases where the air supplied with moisture and heat is supplied to the room as it is. Hence, for example, even when the interior of a cold storage is humidified by the humidity control system (10), the increase in cooling load involved in the humidification can be restrained.

In particular, according to the fourth and fifth aspects, a heat transfer medium for cooling can be used to cool the second air having been heated while being humidified. Therefore, for example, the second air can be cooled to the same temperature as the temperature of a destination to which the second air is to be supplied. For example, even when the interior of a cold storage is humidified by the humidity control system (10), the increase in cooling load involved in the humidification can be sufficiently restrained.

EXPLANATION OF REFERENCE NUMERALS

Figure 1:
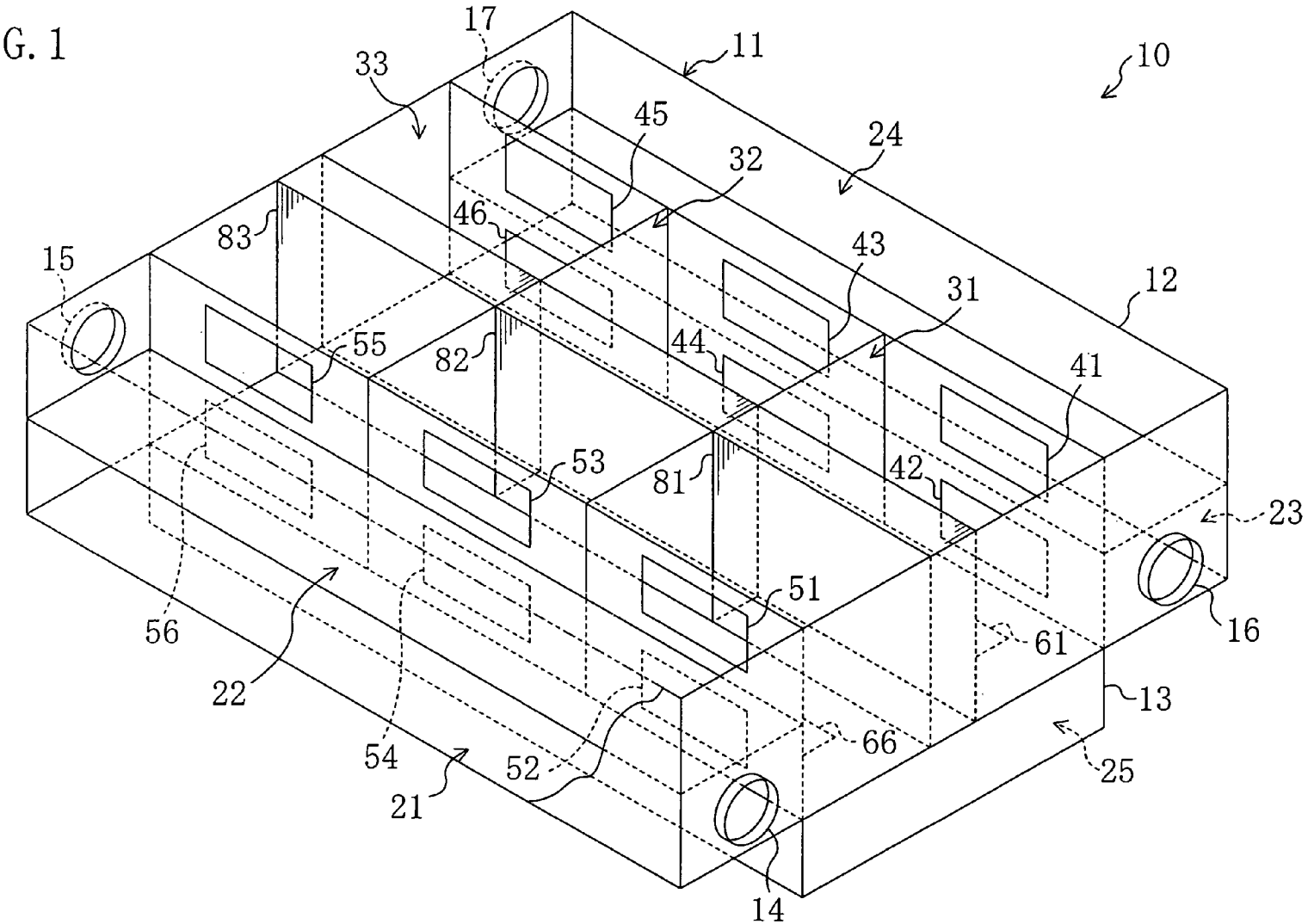
FIG. 1 is a schematic perspective view of a humidity control system according to Embodiment 1.

70 refrigerant circuit (heat transfer medium circuit, regenerator)
71 compressor
72 expansion valve (expansion mechanism)
73 first expansion valve (expansion mechanism)
74 second expansion valve (expansion mechanism)
81 first adsorption heat exchanger (adsorption element)
82 second adsorption heat exchanger (adsorption element)
83 third adsorption heat exchanger (adsorption element)
90 adsorption rotor (adsorption element)
91 adsorption side passage
92 regeneration side passage
93 cooling side passage
94 heating heat exchanger (regenerator)

BEST MODE FOR CARRYING OUT THE INVENTION

Hereinafter, embodiments of the invention will be described below in detail with reference to the drawings.

Embodiment 1 of the Invention

A description is given of Embodiment 1 of the invention. This embodiment is directed to a humidity control system (10) for supplying humidity-controlled air to a room.

<General Structure of Humidity Control System>

Figure 2:
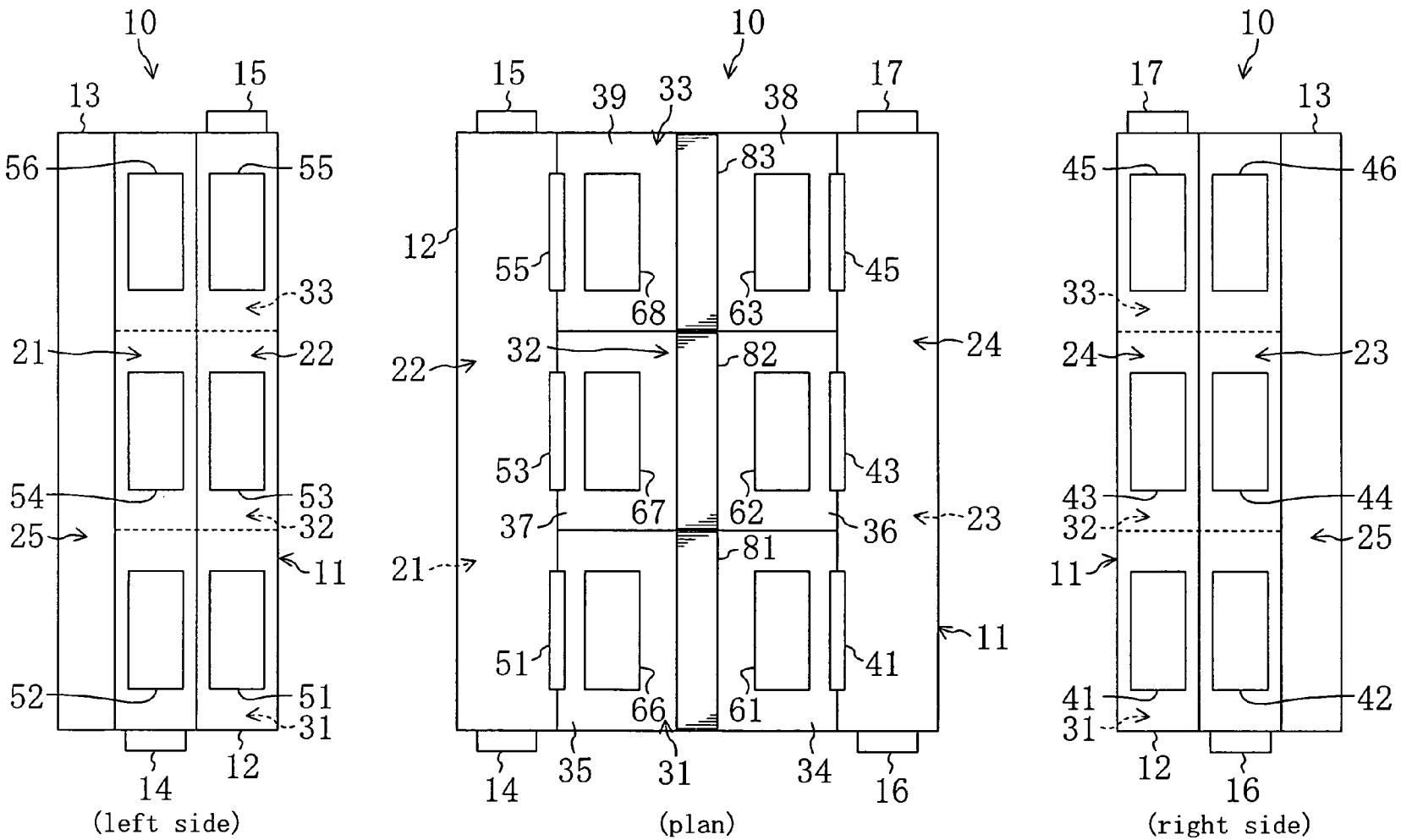
FIG. 2 shows a plan view, a right side view and a left side view of the humidity control system according to Embodiment 1.

With reference to FIGS. 1 and 2, the structure of the humidity control system (10) is described. Note that the following terms used here, "upper", "lower", "right", "left", "front", "rear", "near" and "far", refer to directionalities when the humidity control system (10) according to this embodiment is viewed from the front.

The humidity control system (10) includes a box-shaped casing (11). The casing (11) includes a hollow body (12) formed in a flattish, rectangular parallelepiped shape and a hollow extension (13) formed in a flattish, rectangular parallelepiped shape to a certain extent smaller than the body (12). The extension (13) is attached to the bottom face of the body (12) and disposed in the widthwise middle of the body (12). The interior of the extension (13) provides a single space. This inner space of the extension (13) constitutes a communication passage (25).

The near right side surface of the casing (11) when viewed in FIG. 1 is the front surface and the far left side surface of the casing (11) when viewed in FIG. 1 is the rear surface. Furthermore, the bottom side surface of the casing (11) when viewed in FIG. 2 is the front surface and the top side surface of the casing (11) when viewed in FIG. 2 is the rear surface.

The body (12) of the casing (11) is formed at the front surface with an outside air suction opening (14) and an exhaust opening (16) and formed at the rear surface with an inside air suction opening (15) and an air supply opening (17). In the front surface of the body (12), the outside air suction opening (14) opens at the lower left corner and the exhaust opening (16) opens at the lower right corner. In the rear surface of the body (12), the inside air suction opening (15) opens at the upper left corner and the air supply opening (17) opens at the upper right corner.

The interior of the body (12) has an air supply passage (24) and an exhaust passage (23) formed along the right side surface of the body (12). The air supply passage (24) and the exhaust passage (23) are formed to lie one on the other. The air supply passage (24) communicates with the air supply opening (17), while the exhaust passage (23) communicates with the exhaust opening (16). The air supply passage (24) and the exhaust passage (23) are formed from the front to the rear of the body (12).

The interior of the body (12) further has an inside air passage (22) and an outside air passage (21) formed along the left side surface of the body (12). The inside air passage (22) and the outside air passage (21) are formed to lie one on the other. The inside air passage (22) communicates with the inside air suction opening (15), while the outside air passage (21) communicates with the outside air suction opening (14). The inside air passage (22) and the outside air passage (21) are formed from the front to the rear of the body (12).

A part of the interior of the body (12) located between the right side passages, i.e., the air supply passage (24) and the exhaust passage (23), and the left side passages, i.e., the inside air passage (22) and the outside air passage (21), is divided into three spaces. Out of the three spaces, the nearest space constitutes a first heat exchanger section (31), the space adjacent to the first heat exchanger section (31) constitutes a second heat exchanger section (32) and the farthest space constitutes a third heat exchanger section (33). These heat exchanger sections (31, 32, 33) include adsorption heat exchangers (81, 82, 83) disposed therein, one for each heat exchanger section. Each adsorption heat exchanger (81, 82, 83) is formed in the shape of a thick plate or the shape of a flattish rectangular parallelepiped and allows air to pass through it in the direction of the thickness. The details of each adsorption heat exchanger (81, 82, 83) will be described later.

In each heat exchanger section (31, 32, 33), the adsorption heat exchanger (81, 82, 83) is placed to stand in the widthwise middle of the heat exchanger section (31, 32, 33) and disposed across the heat exchanger section (31, 32, 33) in the front-to-rear direction. Each heat exchanger section (31, 32, 33) is divided into right and left spaces by the associated adsorption heat exchanger (81, 82, 83). In the first heat exchanger section (31), the space on the right side of the first adsorption heat exchanger (81) constitutes a first right section (34) and the space on the left side thereof constitutes a first left section (35). In the second heat exchanger section (32), the space on the right side of the second adsorption heat exchanger (82) constitutes a second right section (36) and the space on the left side thereof constitutes a second left section (37). In the third heat exchanger section (33), the space on the right side of the third adsorption heat exchanger (83) constitutes a third right section (38) and the space on the left side thereof constitutes a third left section (39).

The partition plate separating the right side passages, i.e., the air supply passage (24) and the exhaust passage (23), from the heat exchanger sections (31, 32, 33) is provided with six dampers (41-46).

A part of this partition plate facing the first heat exchanger section (31) is provided at an upper position thereof with a first upper right damper (41) and provided at a lower position thereof with a first lower right damper (42). The opening and closing of the first upper right damper (41) provides and interrupts, respectively, communication between the air supply passage (24) and the first heat exchanger section (31). The opening and closing of the first lower right damper (42) provides and interrupts, respectively, communication between the exhaust passage (23) and the first heat exchanger section (31).

A part of the partition plate facing the second heat exchanger section (32) is provided at an upper position thereof with a second upper right damper (43) and provided at a lower position thereof with a second lower right damper (44). The opening and closing of the second upper right damper (43) provides and interrupts, respectively, communication between the air supply passage (24) and the second heat exchanger section (32). The opening and closing of the second lower right damper (44) provides and interrupts, respectively, communication between the exhaust passage (23) and the second heat exchanger section (32).

A part of the partition plate facing the third heat exchanger section (33) is provided at an upper position thereof with a third upper right damper (45) and provided at a lower position thereof with a third lower right damper (46). The opening and closing of the third upper right damper (45) provides and interrupts, respectively, communication between the air supply passage (24) and the third heat exchanger section (33). The opening and closing of the third lower right damper (46) provides and interrupts, respectively, communication between the exhaust passage (23) and the third heat exchanger section (33).

The partition plate separating the left side passages, i.e., the inside air passage (22) and the outside air passage (21), from the heat exchanger sections (31, 32, 33) is provided with six dampers (51-56).

A part of this partition plate facing the first heat exchanger section (31) is provided at an upper position thereof with a first upper left damper (51) and provided at a lower position thereof with a first lower left damper (52). The opening and closing of the first upper left damper (51) provides and interrupts, respectively, communication between the inside air passage (22) and the first heat exchanger section (31). The opening and closing of the first lower left damper (52) provides and interrupts, respectively, communication between the outside air passage (21) and the first heat exchanger section (31).

A part of the partition plate facing the second heat exchanger section (32) is provided at an upper position thereof with a second upper left damper (53) and provided at a lower position thereof with a second lower left damper (54). The opening and closing of the second upper left damper (53) provides and interrupts, respectively, communication between the inside air passage (22) and the second heat exchanger section (32). The opening and closing of the second lower left damper (54) provides and interrupts, respectively, communication between the outside air passage (21) and the second heat exchanger section (32).

A part of the partition plate facing the third heat exchanger section (33) is provided at an upper position thereof with a third upper left damper (55) and provided at a lower position thereof with a third lower left damper (56). The opening and closing of the third upper left damper (55) provides and interrupts, respectively, communication between the inside air passage (22) and the third heat exchanger section (33). The opening and closing of the third lower left damper (56) provides and interrupts, respectively, communication between the outside air passage (21) and the third heat exchanger section (33).

A part of the bottom plate of the body (12) facing the heat exchanger sections (31, 32, 33) is provided with six dampers (61-63, 66-68).

Specifically, a part of the bottom plate of the body (12) facing the first heat exchanger section (31) is provided to the right side of the first adsorption heat exchanger (81) with a first right bottom damper (61) and provided to the left side thereof with a first left bottom damper (66). The opening and closing of the first right bottom damper (61) provides and interrupts, respectively, communication between the first right section (34) and the communication passage (25). The opening and closing of the first left bottom damper (66) provides and interrupts, respectively, communication between the first left section (35) and the communication passage (25).

A part of the bottom plate facing the second heat exchanger section (32) is provided to the right side of the second adsorption heat exchanger (82) with a second right bottom damper (62) and provided to the left side thereof with a second left bottom damper (67). The opening and closing of the second right bottom damper (62) provides and interrupts, respectively, communication between the second right section (36) and the communication passage (25). The opening and closing of the second left bottom damper (67) provides and interrupts, respectively, communication between the second left section (37) and the communication passage (25).

A part of the bottom plate facing the third heat exchanger section (33) is provided to the right side of the third adsorption heat exchanger (83) with a third right bottom damper (63) and provided to the left side thereof with a third left bottom damper (68). The opening and closing of the third right bottom damper (63) provides and interrupts, respectively, communication between the third right section (38) and the communication passage (25). The opening and closing of the third left bottom damper (68) provides and interrupts, respectively, communication between the third left section (39) and the communication passage (25).

The body (12) contains an air supply fan and an exhaust fan, although they are not shown. The air supply fan is disposed in the air supply passage (24) in the vicinity of the air supply opening (17). The exhaust fan is disposed in the exhaust passage (23) in the vicinity of the exhaust opening (16).

<Structure of Refrigerant Circuit>

The humidity control system (10) includes a refrigerant circuit (70). The refrigerant circuit (70) is a closed circuit filled with refrigerant and is contained in the casing (11).

Figure 3:
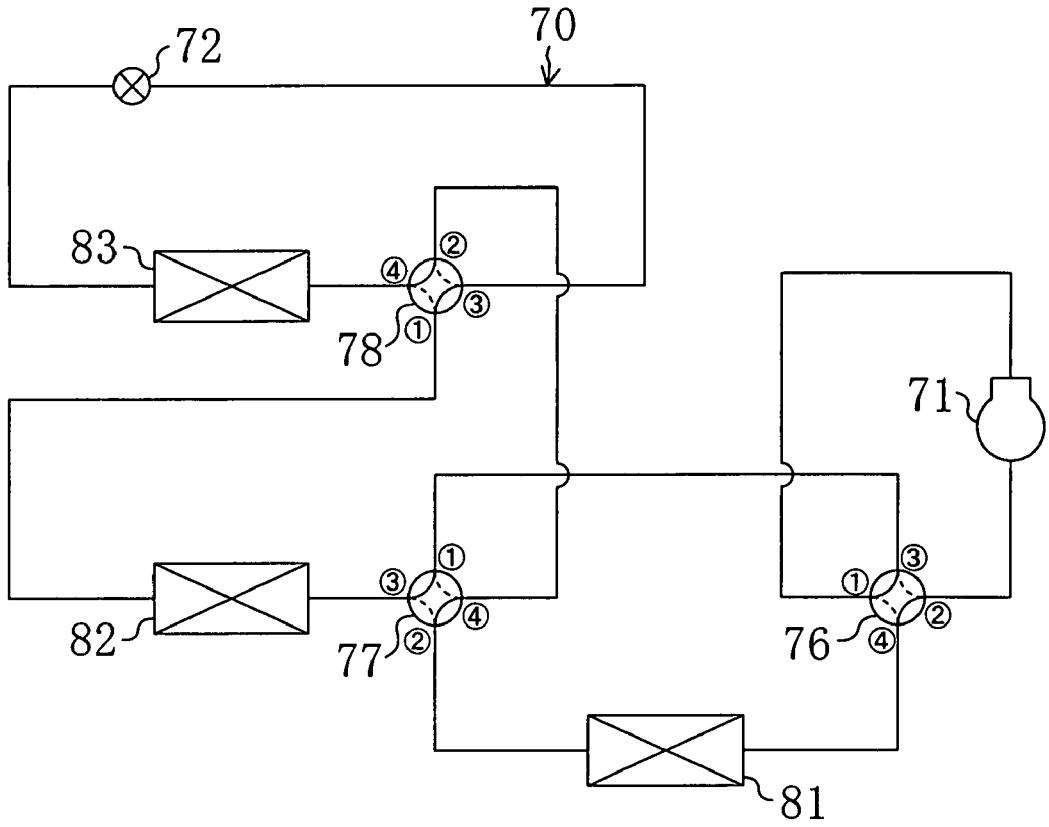
FIG. 3 is a piping diagram of a refrigerant circuit in the humidity control system according to Embodiment 1.

As shown in FIG. 3, the refrigerant circuit (70) includes three adsorption heat exchangers (81, 82, 83) connected therein. The refrigerant circuit (70) further includes a single compressor (71), a single expansion valve (72) and three four-way selector valves (76, 77, 78) which are all connected therein. The expansion valve (72) constitutes an expansion mechanism for the refrigerant.

In the refrigerant circuit (70), the compressor (71) is connected at its discharge side to the first port of the first four-way selector valve (76) and connected at its suction side to the second port of the first four-way selector valve (76). The first adsorption heat exchanger (81) is connected at one end to the fourth port of the first four-way selector valve (76) and connected at the other end to the second port of the second four-way selector valve (77). The third port of the first four-way selector valve (76) is connected to the first port of the second four-way selector valve (77). The second adsorption heat exchanger (82) is connected at one end to the third port of the second four-way selector valve (77) and connected at the other end to the first port of the third four-way selector valve (78). The fourth port of the second four-way selector valve (77) is connected to the second port of the third four-way selector valve (78). The third adsorption heat exchanger (83) is connected at one end to the fourth port of the third four-way selector valve (78) and connected at the other end via the expansion valve (72) to the third port of the third four-way selector valve (78).

The three four-way selector valves (76, 77, 78) are each switchable between a first position in which the first and third ports communicate with each other and the second and fourth ports communicate with each other (the position shown in the solid lines in FIG. 3) and a second position in which the first and fourth ports communicate with each other and the second and third ports communicate with each other (the position shown in the broken lines in FIG. 3).

Each of the three adsorption heat exchangers (81, 82, 83) is formed of a so-called cross fin type fin-and-tube heat exchanger. Specifically, each of the adsorption heat exchangers (81, 82, 83) is composed of a heat exchanger tube made of copper and a large number of fins made of aluminium and allows heat exchange between the refrigerant flowing through the heat exchanger tube and air passing between the fins. Each adsorption heat exchanger (81, 82, 83) has an adsorbent, such as zeolite, carried on the fin surfaces in contact with air. These adsorption heat exchangers (81, 82, 83) constitute adsorption elements allowing the air passing therethrough to come into contact with their adsorbents.

The refrigerant circuit (70) operates in a refrigeration cycle by circulating the refrigerant with which it is filled. The refrigerant circuit (70) constitutes a heat transfer medium circuit for supplying refrigerant as a heat transfer medium for heating or a heat transfer medium for cooling to the heat exchanger tubes of the adsorption heat exchangers (81, 82, 83). The refrigerant circuit (70) constitutes also a regenerator for regenerating the adsorbents carried on the surfaces of the adsorption heat exchangers (81, 82, 83) by heating them.

—Operational Behavior—

The humidity control system (10) performs a humidification operation. The humidity control system (10) during the humidification operation recovers moisture from in-storage air discharged from a cold storage and supplies outside air humidified by the recovered moisture to the interior of the cold storage. The humidity control system (10) during the humidification operation sequentially repeats a first mode, a second mode and a third mode.

<First Mode>

In the humidity control system (10) during the first mode, the first adsorption heat exchanger (81) is intended for an adsorption action, the second adsorption heat exchanger (82) is intended for a regeneration action and the third adsorption heat exchanger (83) is intended for a cooling action.

Figure 4:
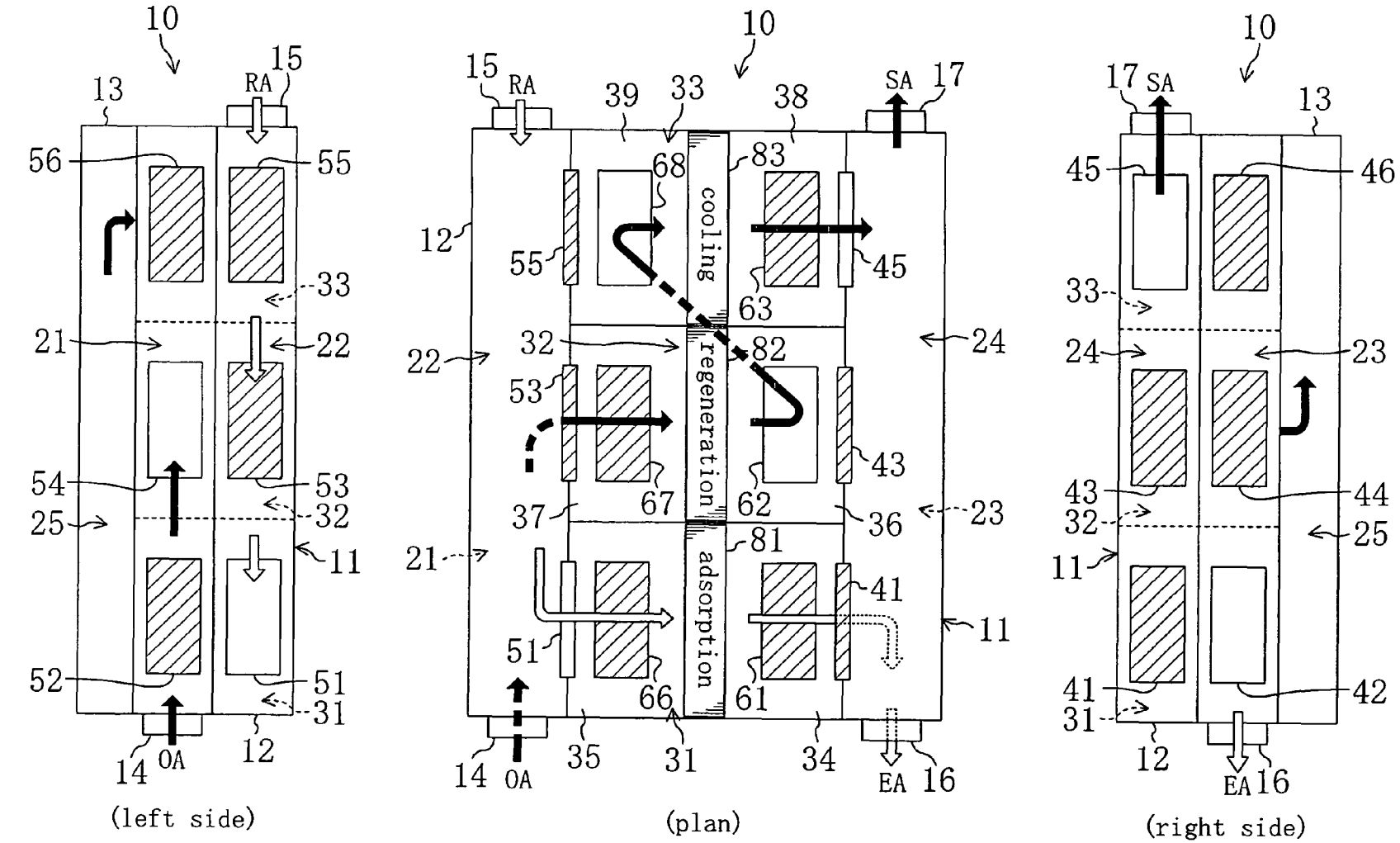
FIG. 4 shows a plan view, a right side view and a left side view of the humidity control system according to Embodiment 1, illustrating the air flow during a first mode of a humidification operation.

As shown in FIG. 4, in the first mode, the first lower right damper (42), the third upper right damper (45), the first upper left damper (51), the second lower left damper (54), the second right bottom damper (62) and the third left bottom damper (68) are open and the remaining dampers are closed.

Figure 5:
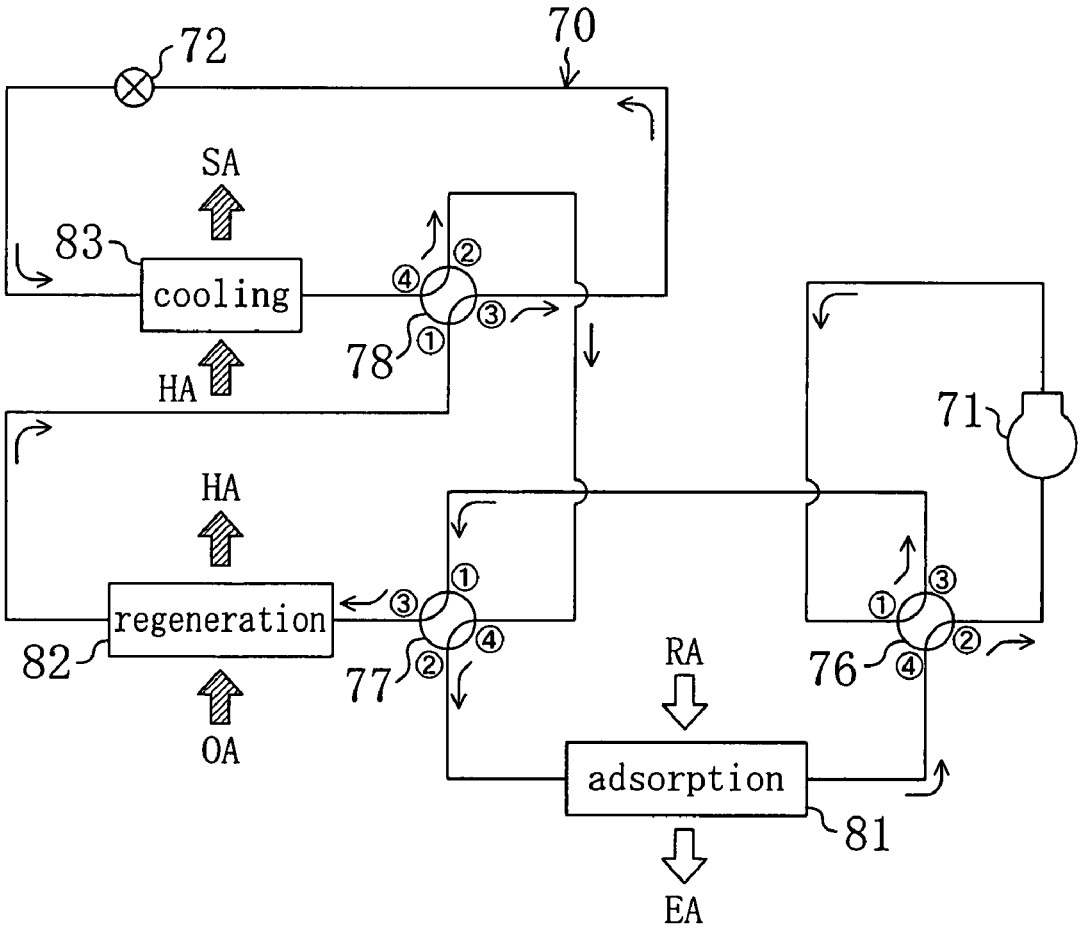
FIG. 5 is a piping diagram of the refrigerant circuit in the humidity control system according to Embodiment 1, illustrating the air flow during the first mode of the humidification operation.

Furthermore, as shown in FIG. 5, in the refrigerant circuit (70) during the first mode, all the four-way selector valves (76, 77, 78) are set to their first positions. In this state, refrigerant discharged from the compressor (71) passes through the second adsorption heat exchanger (82), the expansion valve (72), the third adsorption heat exchanger (83) and the first adsorption heat exchanger (81) in this order and is then sucked into the compressor (71). In this case, in the refrigeration circuit (70), the second adsorption heat exchanger (82) serves as a condenser and the third and first adsorption heat exchangers (83, 81) serve as evaporators.

The in-storage air is taken as a first air through the inside air suction opening (15) into the inside air passage (22). The first air flows into the first heat exchanger section (31) and passes through the first adsorption heat exchanger (81). In the first adsorption heat exchanger (81), moisture in the first air is adsorbed on the adsorbent and heat of adsorption produced during the moisture adsorption is taken by the refrigerant. Thereafter, the first air flows into the exhaust passage (23) and is exhausted through the exhaust opening (16) to the outside of the cold storage.

The air outside the cold storage is taken as a second air through the outside air suction opening (14) into the outside air passage (21). The second air flows into the second heat exchanger section (32) and passes through the second adsorption heat exchanger (82). In the second adsorption heat exchanger (82), moisture is desorbed from the adsorbent heated by the refrigerant and the second air is humidified by the desorbed moisture. During the humidification, the temperature of the second air is slightly increased by heat exchange with the refrigerant.

Thereafter, the second air passes through the second right section (36), then flows through the second right bottom damper (62) into the communication passage (25) and then flows through the third left bottom damper (68) into the third left section (39). The second air having flowed into the third left section (39) passes through the third adsorption heat exchanger (83). In the third adsorption heat exchanger (83), the second air is cooled by heat exchange with the refrigerant. The third adsorption heat exchanger (83) has already adsorbed moisture in the first air during the third mode performed just before the first mode and, therefore, the adsorbent on the surface of the third adsorption heat exchanger (83) is almost saturated. A description of the third mode will be given later. For the above reason, only heat is taken from the second air passing through the third adsorption heat exchanger (83) but little or no moisture is taken from it. Then, the second air humidified by the second adsorption heat exchanger (82) and then cooled by the third adsorption heat exchanger (83) flows into the air supply passage (24) and is supplied through the air supply opening (17) into the cold storage.

<Second Mode>

When performing the first mode for a certain period of time (for example, five or six minutes), the humidity control system (10) terminates the first mode and starts the second mode. The switching from the first mode to the second mode is preferably carried out at the timing when the first adsorption heat exchanger (81) is saturated too much to adsorb moisture.

In the humidity control system (10) during the second mode, the first adsorption heat exchanger (81) is intended for a cooling action, the second adsorption heat exchanger (82) is intended for an adsorption action and the third adsorption heat exchanger (83) is intended for an regeneration action.

Figure 6:
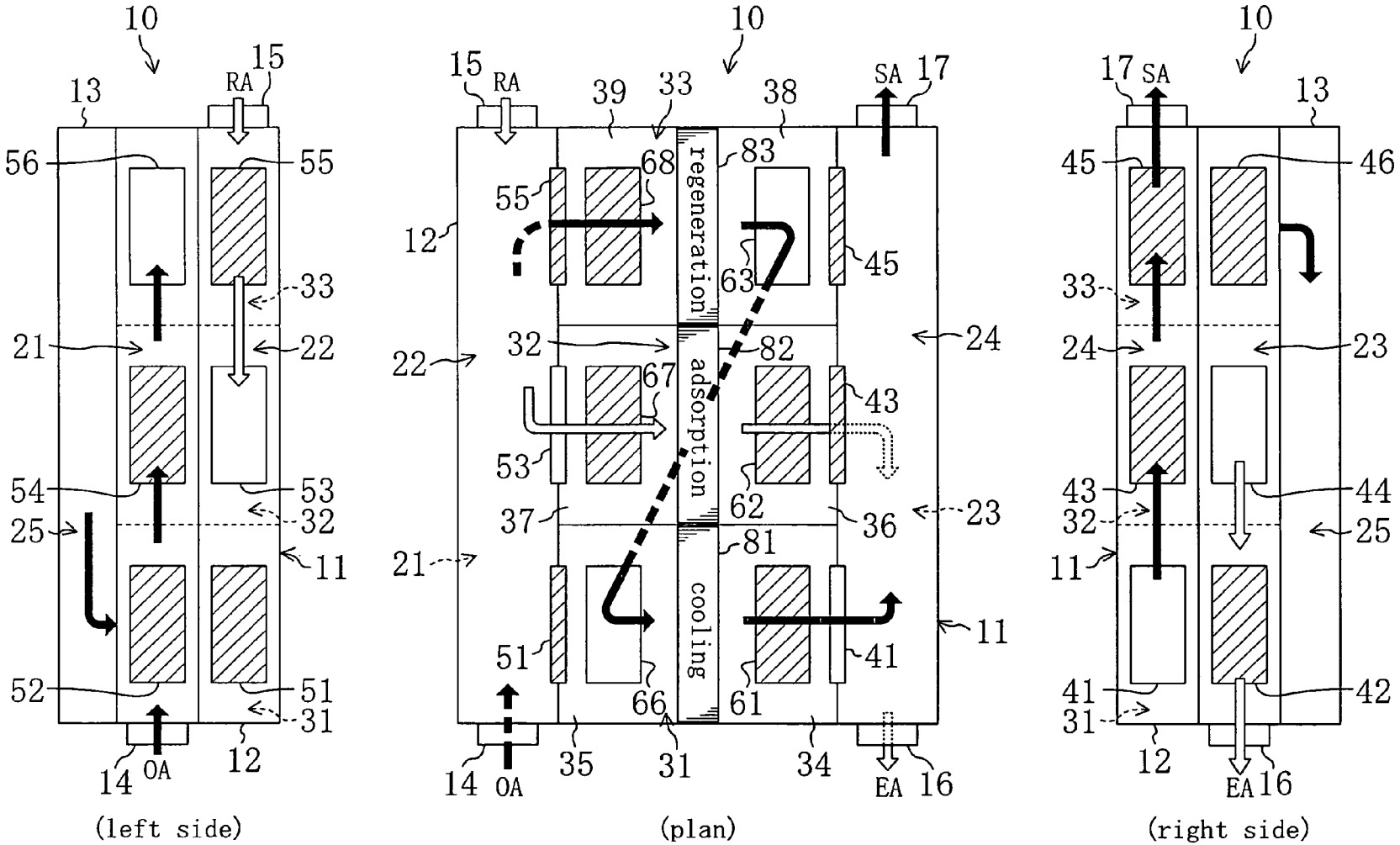
FIG. 6 shows a plan view, a right side view and a left side view of the humidity control system according to Embodiment 1, illustrating the air flow during a second mode of the humidification operation.

As shown in FIG. 6, in the second mode, the first upper right damper (41), the second lower right damper (44), the second upper left damper (53), the third lower left damper (56), the third right bottom damper (63) and the first left bottom damper (65) are open and the remaining dampers are closed.

Figure 7:
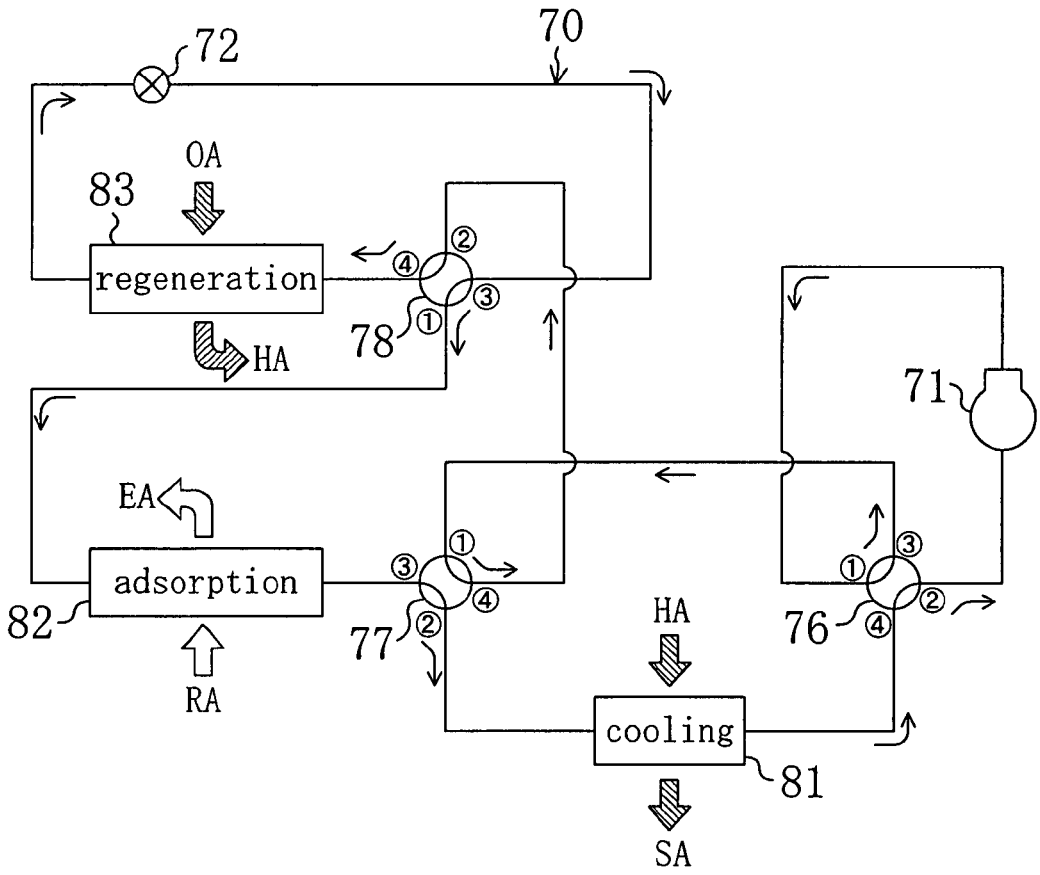
FIG. 7 is a piping diagram of the refrigerant circuit in the humidity control system according to Embodiment 1, illustrating the air flow during the second mode of the humidification operation.

Furthermore, as shown in FIG. 7, in the refrigerant circuit (70) during the second mode, the first and third four-way selector valves (76, 78) are set to their first positions and the second four-way selector valve (77) is set to its second position. In this state, refrigerant discharged from the compressor (71) passes through the third adsorption heat exchanger (83), the expansion valve (72), the second adsorption heat exchanger (82) and the first adsorption heat exchanger (81) in this order and is then sucked into the compressor (71). In this case, in the refrigeration circuit (70), the third adsorption heat exchanger (83) serves as a condenser and the second and first adsorption heat exchangers (82, 81) serve as evaporators.

The in-storage air is taken as a first air through the inside air suction opening (15) into the inside air passage (22). The first air flows into the second heat exchanger section (32) and passes through the second adsorption heat exchanger (82). In the second adsorption heat exchanger (82), moisture in the first air is adsorbed on the adsorbent and heat of adsorption produced during the moisture adsorption is taken by the refrigerant. Thereafter, the first air flows into the exhaust passage (23) and is exhausted through the exhaust opening (16) to the outside of the cold storage.

The air outside the cold storage is taken as a second air through the outside air suction opening (14) into the outside air passage (21). The second air flows into the third heat exchanger section (33) and passes through the third adsorption heat exchanger (83). In the third adsorption heat exchanger (83), moisture is desorbed from the adsorbent heated by the refrigerant and the second air is humidified by the desorbed moisture. During the humidification, the temperature of the second air is slightly increased by heat exchange with the refrigerant.

Thereafter, the second air passes through the third right section (38), then flows through the third right bottom damper (63) into the communication passage (25) and then flows through the first left bottom damper (66) into the first left section (35). The second air having flowed into the first left section (35) passes through the first adsorption heat exchanger (81). In the first adsorption heat exchanger (81), the second air is cooled by heat exchange with the refrigerant. The first adsorption heat exchanger (81) has already adsorbed moisture in the first air during the first mode performed just before the second mode and, therefore, the adsorbent on the surface of the first adsorption heat exchanger (81) is almost saturated. For this reason, only heat is taken from the second air passing through the first adsorption heat exchanger (81) but little or no moisture is taken from it. Then, the second air humidified by the third adsorption heat exchanger (83) and then cooled by the first adsorption heat exchanger (81) flows into the air supply passage (24) and is supplied through the air supply opening (17) into the cold storage.

<Third Mode>

When performing the second mode for a certain period of time (for example, five or six minutes), the humidity control system (10) terminates the second mode and starts the third mode. The switching from the second mode to the third mode is preferably carried out at the timing when the second adsorption heat exchanger (82) is saturated too much to adsorb moisture.

In the humidity control system (10) during the third mode, the first adsorption heat exchanger (81) is intended for an regeneration action, the second adsorption heat exchanger (82) is intended for a cooling action and the third adsorption heat exchanger (83) is intended for an adsorption action.

Figure 8:
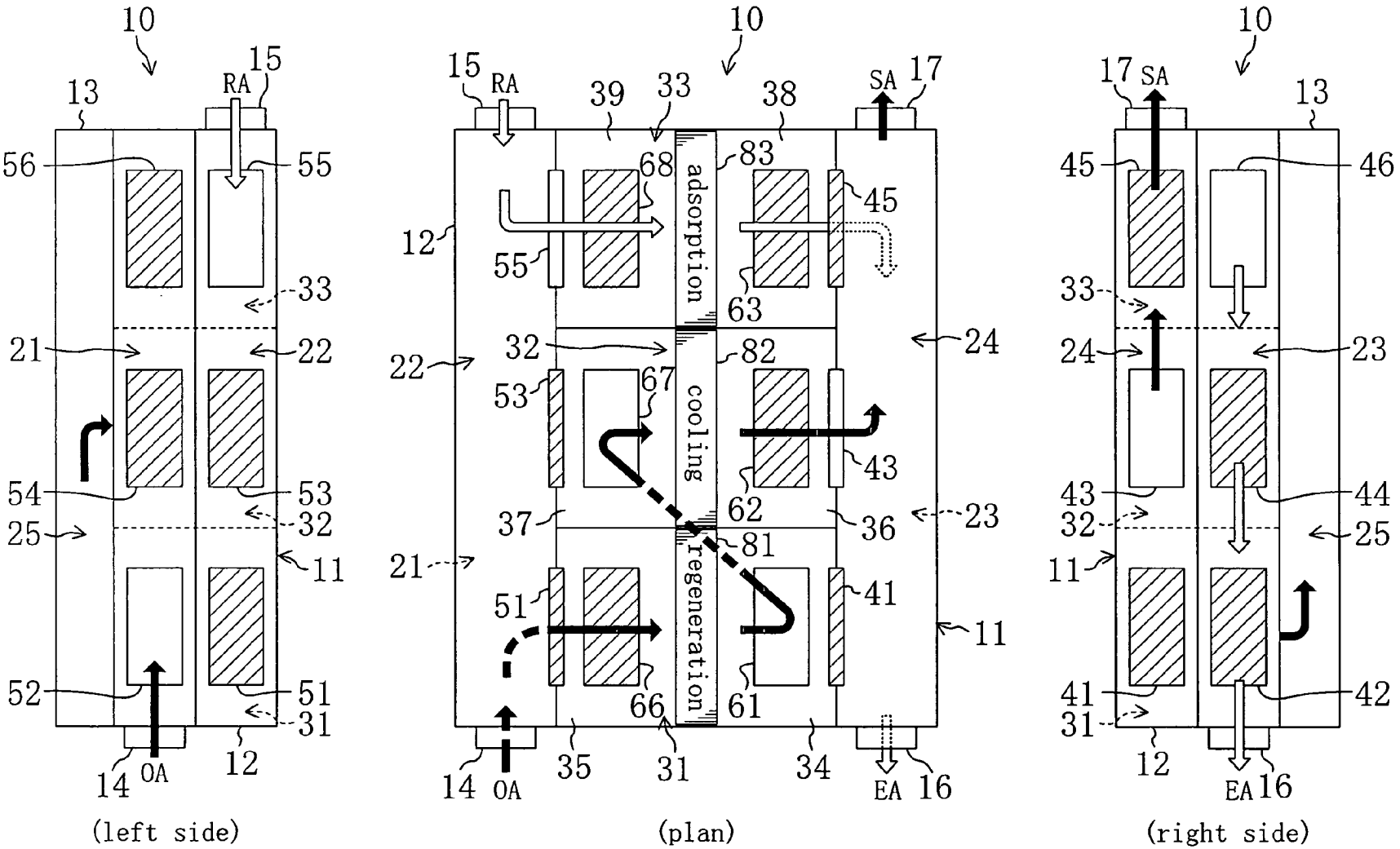
FIG. 8 shows a plan view, a right side view and a left side view of the humidity control system according to Embodiment 1, illustrating the air flow during a third mode of the humidification operation.

As shown in FIG. 8, in the third mode, the second upper right damper (43), the third lower right damper (46), the first upper left damper (52), the third upper left damper (55), the first right bottom damper (61) and the second left bottom damper (67) are open and the remaining dampers are closed.

Figure 9:
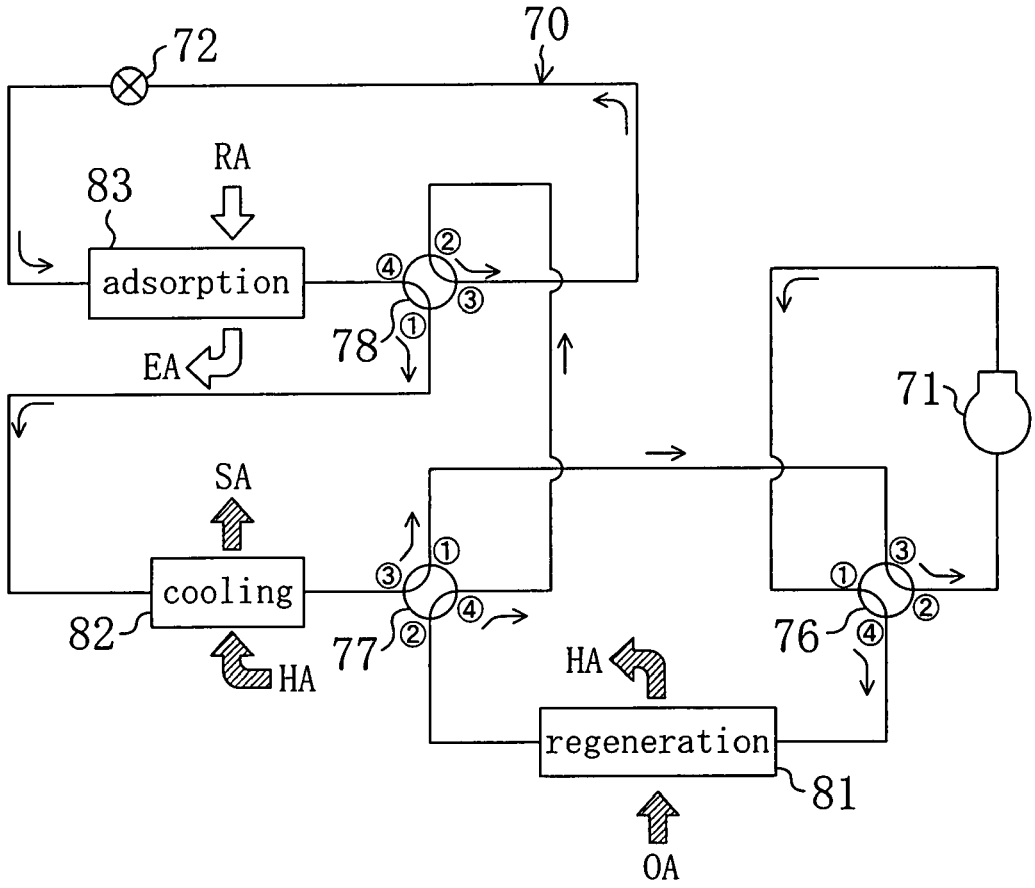
FIG. 9 is a piping diagram of the refrigerant circuit in the humidity control system according to Embodiment 1, illustrating the air flow during the third mode of the humidification operation.

Furthermore, as shown in FIG. 9, in the refrigerant circuit (70) during the third mode, the second four-way selector valve (77) is set to its first position and the first and third four-way selector valves (76, 78) are set to their second positions. In this state, refrigerant discharged from the compressor (71) passes through the first adsorption heat exchanger (81), the expansion valve (72), the third adsorption heat exchanger (83) and the second adsorption heat exchanger (82) in this order and is then sucked into the compressor (71). In this case, in the refrigeration circuit (70), the first adsorption heat exchanger (81) serves as a condenser and the third and second adsorption heat exchangers (83, 82) serve as evaporators.

The in-storage air is taken as a first air through the inside air suction opening (15) into the inside air passage (22). The first air flows into the third heat exchanger section (33) and passes through the third adsorption heat exchanger (83). In the third adsorption heat exchanger (83), moisture in the first air is adsorbed on the adsorbent and heat of adsorption produced during the moisture adsorption is taken by the refrigerant. Thereafter, the first air flows into the exhaust passage (23) and is exhausted through the exhaust opening (16) to the outside of the cold storage.

The air outside the cold storage is taken as a second air through the outside air suction opening (14) into the outside air passage (21). The second air flows into the first heat exchanger section (31) and passes through the first adsorption heat exchanger (81). In the first adsorption heat exchanger (81), moisture is desorbed from the adsorbent heated by the refrigerant and the second air is humidified by the desorbed moisture. During the humidification, the temperature of the second air is slightly increased by heat exchange with the refrigerant.

Thereafter, the second air passes through the first right section (34), then flows through the first right bottom damper (61) into the communication passage (25) and then flows through the second left bottom damper (67) into the second left section (37). The second air having flowed into the second left section (37) passes through the second adsorption heat exchanger (82). In the second adsorption heat exchanger (82), the second air is cooled by heat exchange with the refrigerant. The second adsorption heat exchanger (82) has already adsorbed moisture in the first air during the second mode performed just before the third mode and, therefore, the adsorbent on the surface of the second adsorption heat exchanger (82) is almost saturated. For this reason, only heat is taken from the second air passing through the second adsorption heat exchanger (82) but little or no moisture is taken from it. Then, the second air humidified by the first adsorption heat exchanger (81) and then cooled by the second adsorption heat exchanger (82) flows into the air supply passage (24) and is supplied through the air supply opening (17) into the cold storage.

When performing the third mode for a certain period of time (for example, five or six minutes), the humidity control system (10) terminates the third mode and starts the first mode. The switching from the third mode to the first mode is preferably carried out at the timing when the third adsorption heat exchanger (83) is saturated too much to adsorb moisture.

—Effects of Embodiment 1—

In the humidity control system (10) of this embodiment, the second air given moisture and heat in the adsorption heat exchanger intended for an regeneration action is sent to the adsorption heat exchanger whose adsorbent has already adsorbed a relatively large amount of moisture. Therefore, by using the adsorption heat exchanger (81, 82, 83) having already adsorbed moisture, only heat can be taken from the second air given both moisture and heat. Hence, according to this embodiment, the temperature of the second air supplied to the room by the humidity control system (10) during the humidification operation can be reduced as compared to the conventional cases where the air supplied with moisture and heat is supplied to the room as it is. In addition, for example, even when the interior of a cold storage is humidified by the humidity control system (10), the increase in cooling load involved in the humidification can be restrained.

Furthermore, in the humidity control system (10) of this embodiment, the adsorption heat exchanger intended for a cooling action serves as an evaporator in each of the first, second and third modes performed during the humidification operation. Therefore, the second air humidified by the adsorption heat exchanger serving as an evaporator can be sufficiently cooled. Furthermore, for example, the second air can be cooled to the same temperature as the internal temperature of the cold storage to which the second air is to be supplied, which can sufficiently restrain the increase in the cooling load in the cold storage involved in humidification.

—Modification of Embodiment 1—

In the humidification operation of the above humidity control system (10), moisture may be taken from the air outside the cold storage and the in-storage air humidified by the taken moisture may be returned into the cold storage. Here, a description is given of the behavior of the humidity control system (10) during this humidification operation only in different points from the behavior thereof during a humidification operation for ventilating the cold storage.

Figure 10:
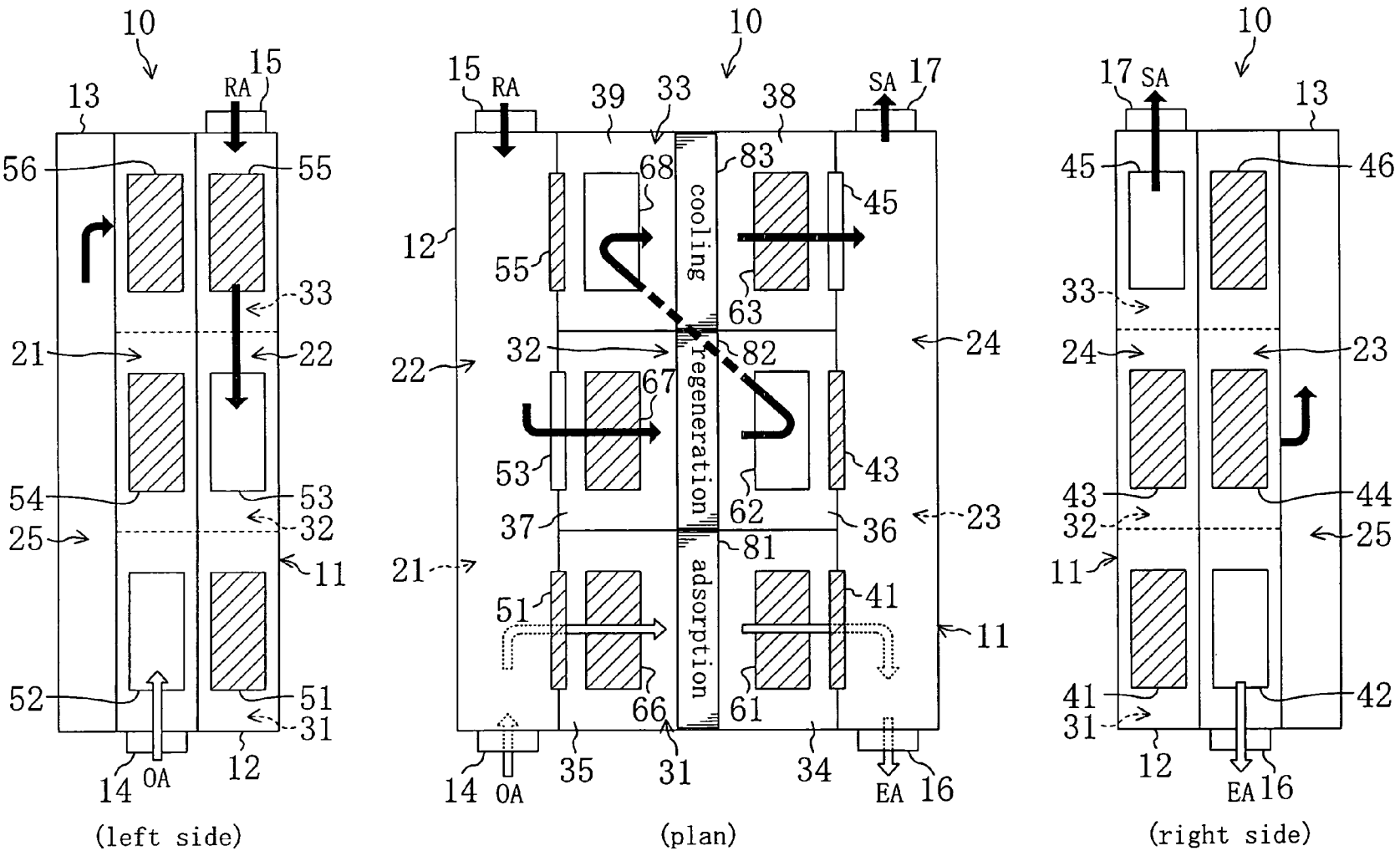
FIG. 10 shows a plan view, a right side view and a left side view of a humidity control system according to a modification of Embodiment 1, illustrating the air flow during a first mode of a humidification operation.

In the first mode of this humidification operation, as shown in FIG. 10, the first lower left damper (52) is open instead of the first upper left damper (51) and the second upper left damper (53) is open instead of the second lower left damper (54). In this state, the air outside the cold storage is taken as a first air into the outside air passage (21). The first air taken in flows into the first heat exchanger section (31) and passes through the first adsorption heat exchanger (81). On the other hand, the in-storage air is taken as a second air into the inside air passage (22). The second air taken in flows into the second heat exchanger section (32) and passes through the second adsorption heat exchanger (82).

Figure 11:
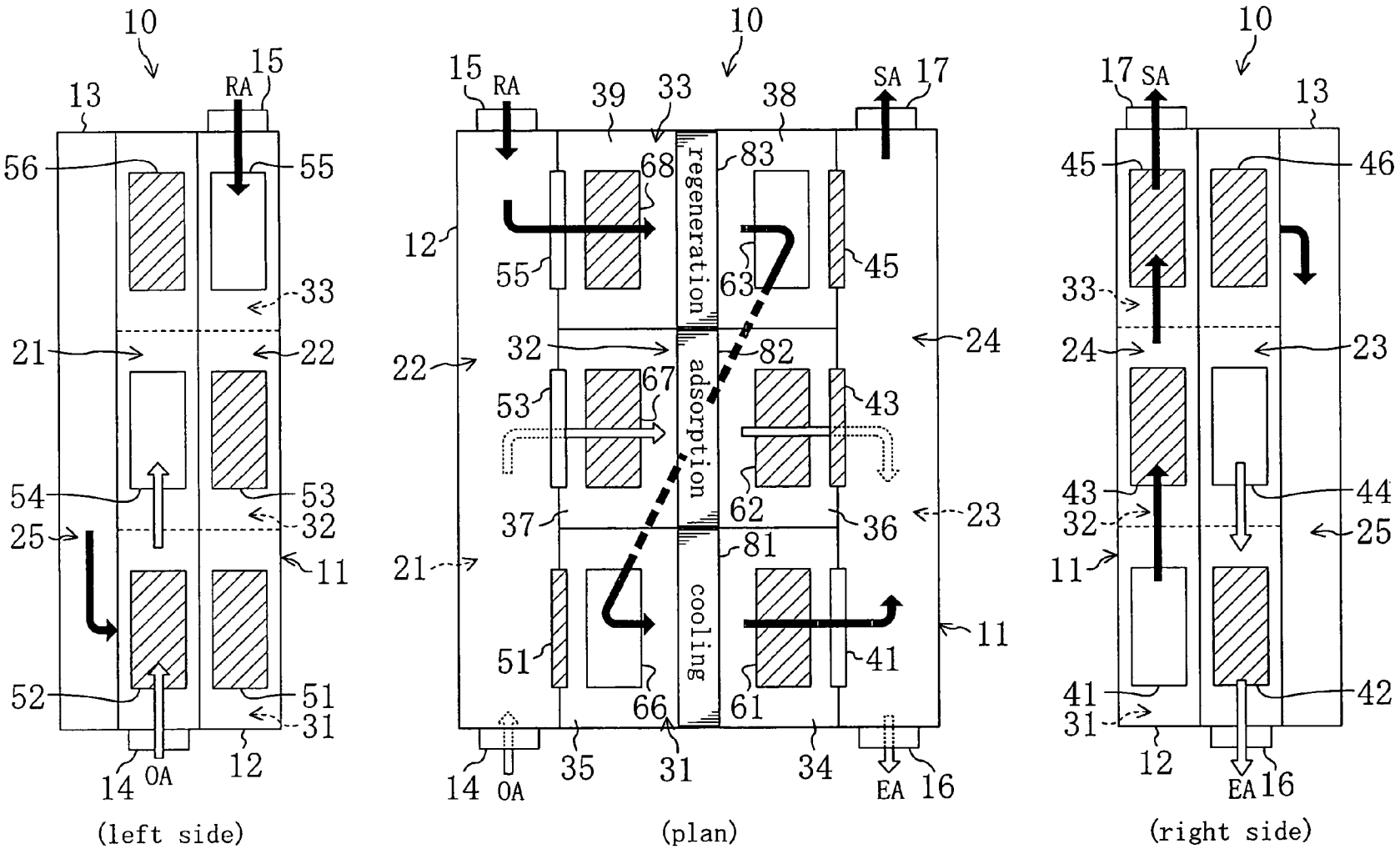
FIG. 11 shows a plan view, a right side view and a left side view of the humidity control system according to the modification of Embodiment 1, illustrating the air flow during a second mode of the humidification operation.

In the second mode of this humidification operation, as shown in FIG. 11, the second lower left damper (54) is open instead of the second upper left damper (53) and the third upper left damper (55) is open instead of the third lower left damper (56). In this state, the air outside the cold storage is taken as a first air into the outside air passage (21). The first air taken in flows into the second heat exchanger section (32) and passes through the second adsorption heat exchanger (82). On the other hand, the in-storage air is taken as a second air into the inside air passage (22). The second air taken in flows into the third heat exchanger section (33) and passes through the third adsorption heat exchanger (83).

Figure 12:
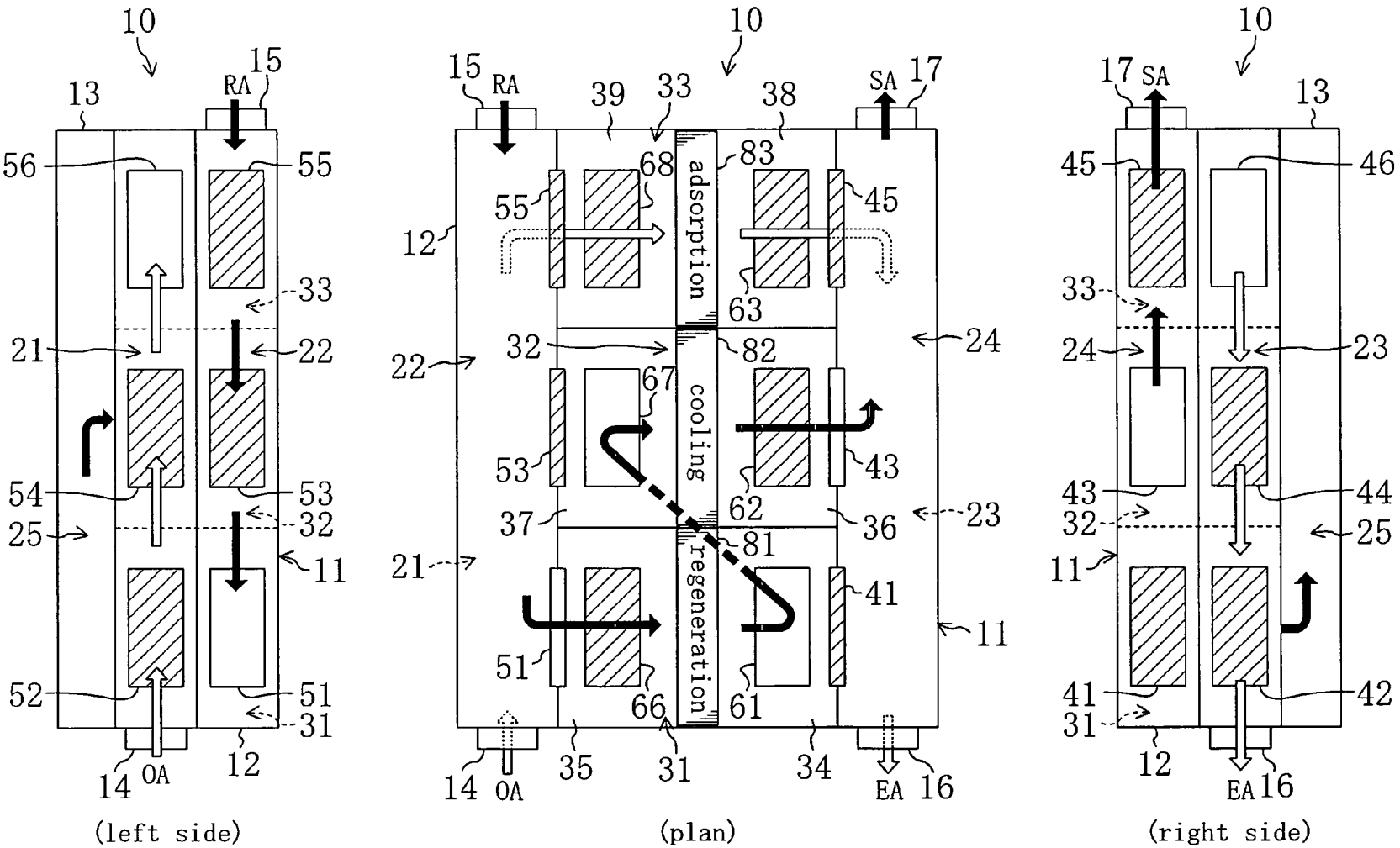
FIG. 12 shows a plan view, a right side view and a left side view of the humidity control system according to the modification of Embodiment 1, illustrating the air flow during a third mode of the humidification operation.

In the third mode of this humidification operation, as shown in FIG. 12, the third lower left damper (56) is open instead of the third upper left damper (55) and the first upper left damper (51) is open instead of the first lower left damper (52). In this state, the air outside the cold storage is taken as a first air into the outside air passage (21). The first air taken in flows into the third heat exchanger section (33) and passes through the third adsorption heat exchanger (83). On the other hand, the in-storage air is taken as a second air into the inside air passage (22). The second air taken in flows into the first heat exchanger section (31) and passes through the first adsorption heat exchanger (81).

Embodiment 2 of the Invention

A description is given of Embodiment 2 of the invention. This embodiment differs from the humidity control system (10) of Embodiment 1 in the structure of the refrigerant circuit (70).

Figure 13:
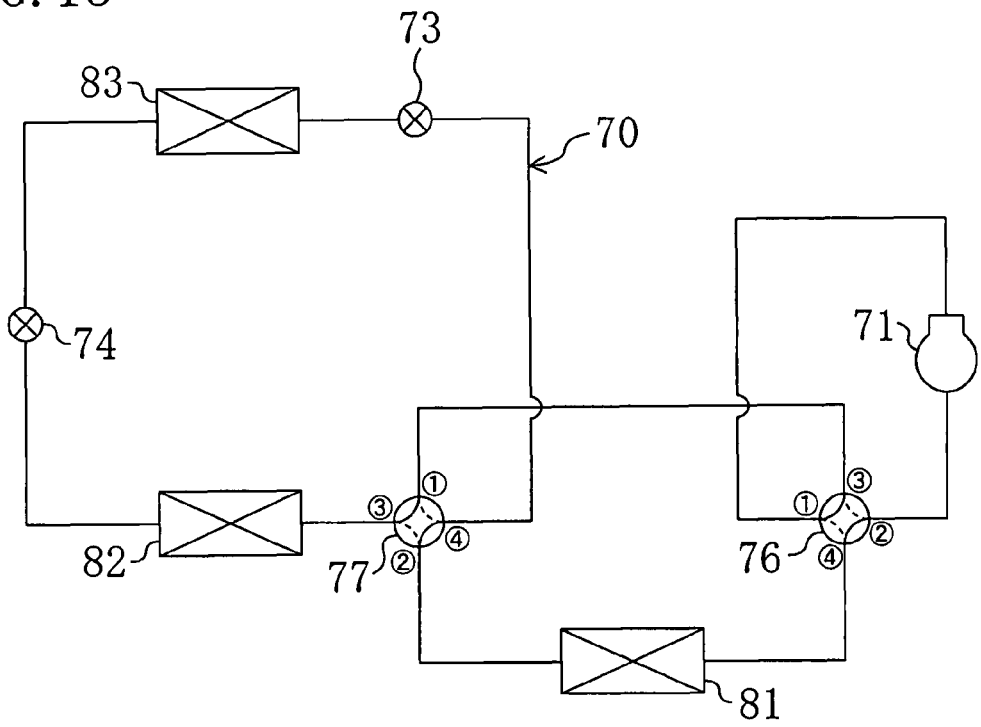
FIG. 13 is a piping diagram of a refrigerant circuit in a humidity control system according to Embodiment 2.
Figure 14:
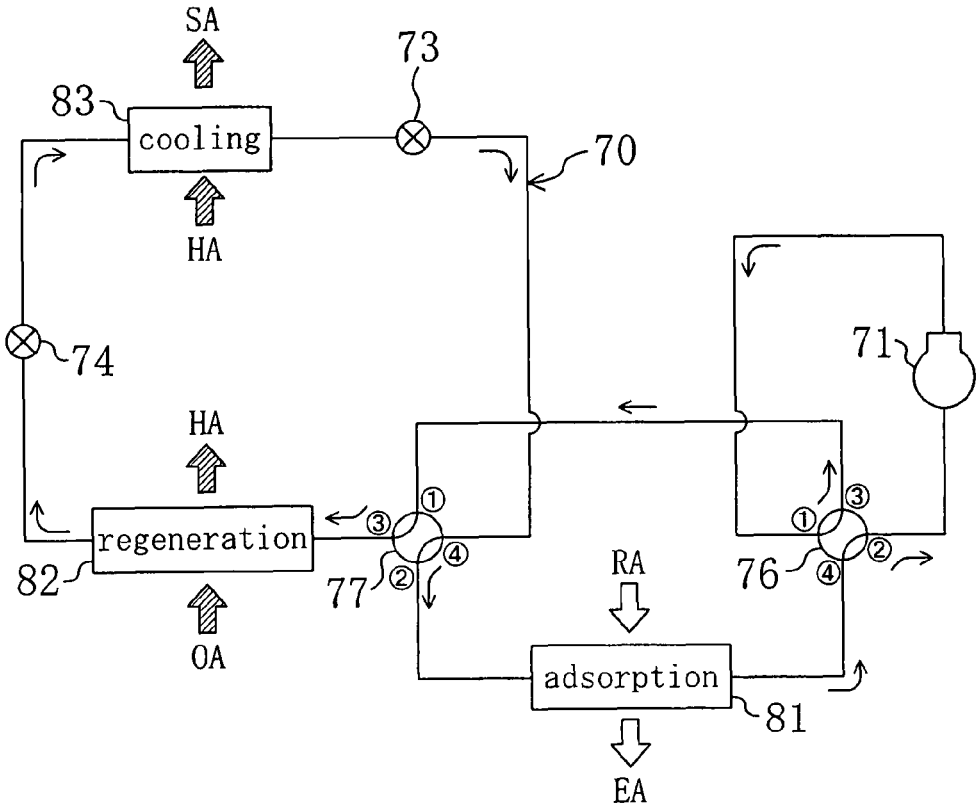
FIG. 14 is a piping diagram of the refrigerant circuit in the humidity control system according to Embodiment 2, illustrating the air flow during a first mode of a humidification operation.
Figure 15:
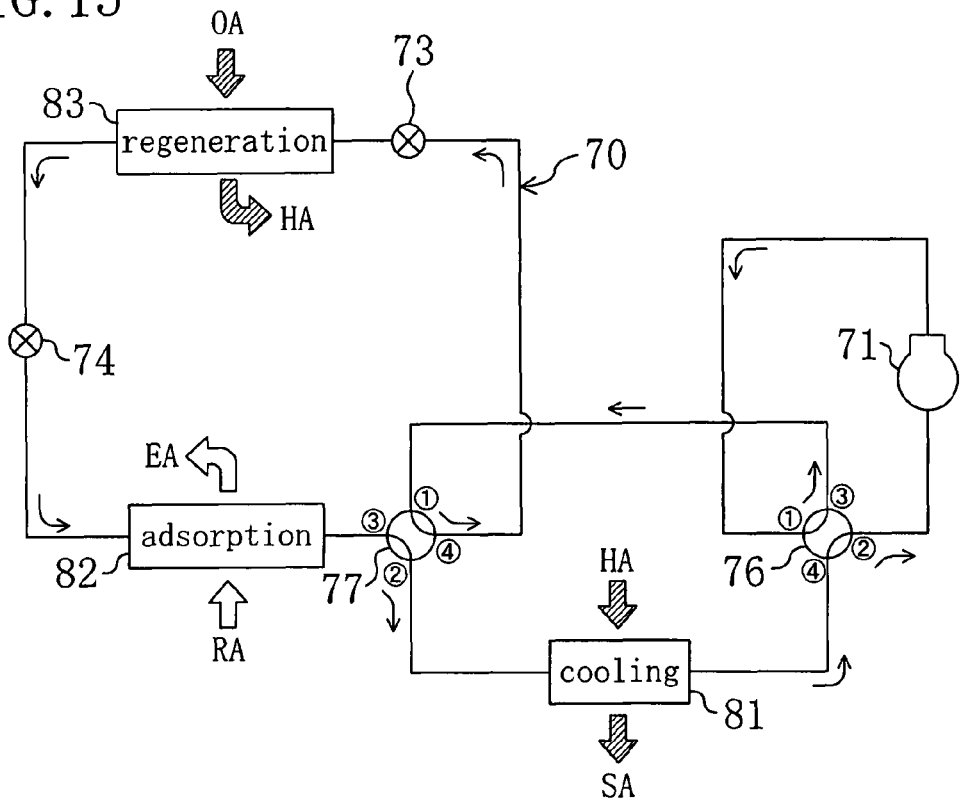
FIG. 15 is a piping diagram of the refrigerant circuit in the humidity control system according to Embodiment 2, illustrating the air flow during a second mode of the humidification operation.
Figure 16:
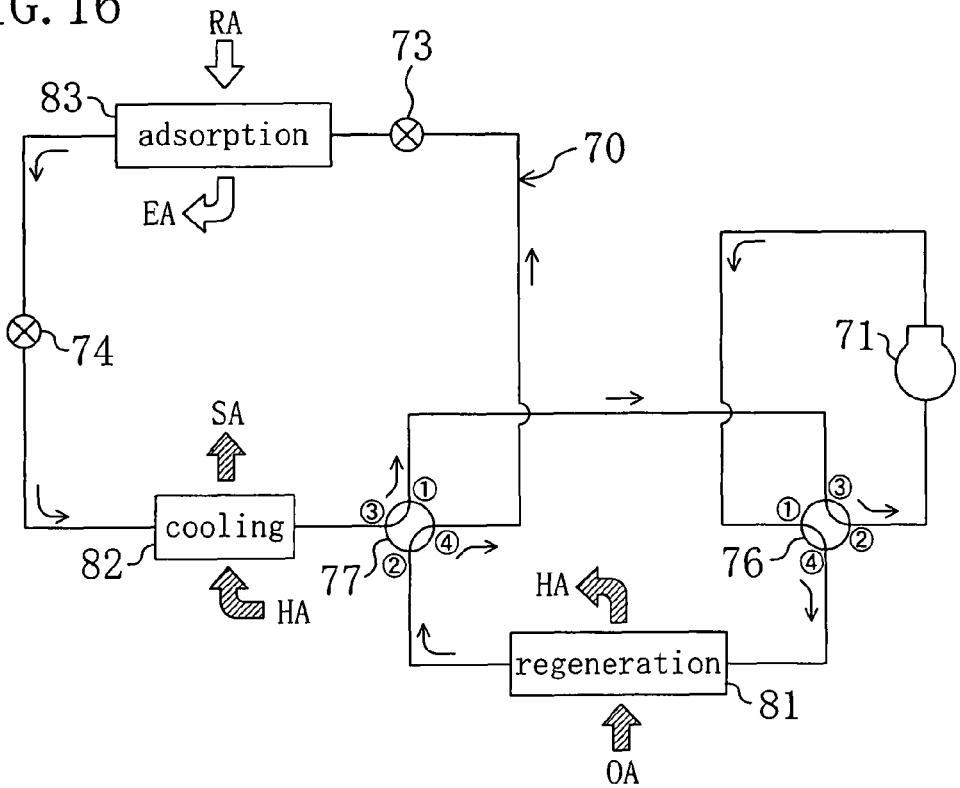
FIG. 16 is a piping diagram of the refrigerant circuit in the humidity control system according to Embodiment 2, illustrating the air flow during a third mode of the humidification operation.

As shown in FIG. 13, the refrigerant circuit (70) includes three adsorption heat exchangers (81, 82, 83) connected therein. The adsorption heat exchangers (81, 82, 83) have the same configurations as those in Embodiment 1. The refrigerant circuit (70) further includes a single compressor (71), two expansion valves (73, 74) and two four-way selector valves (76, 77) which are all connected therein. Each of the two expansion valves (73, 74) constitutes an expansion mechanism for refrigerant.

In the refrigerant circuit (70), the compressor (71) is connected at its discharge side to the first port of the first four-way selector valve (76) and connected at its suction side to the second port of the first four-way selector valve (76). The first adsorption heat exchanger (81) is connected at one end to the fourth port of the first four-way selector valve (76) and connected at the other end to the second port of the second four-way selector valve (77). The third port of the first four-way selector valve (76) is connected to the first port of the second four-way selector valve (77). In the refrigerant circuit (70), the second adsorption heat exchanger (82), the second expansion valve (74), the third adsorption heat exchanger (83) and the first expansion valve (73) are arranged in this order from the third port of the second four-way selector valve (77) towards the fourth port of the second four-way selector valve (77).

The two four-way selector valves (76, 77) are each switchable between a first position in which the first and third ports communicate with each other and the second and fourth ports communicate with each other (the position shown in the solid lines in FIG. 13) and a second position in which the first and fourth ports communicate with each other and the second and third ports communicate with each other (the position shown in the broken lines in FIG. 13).

—Operational Behavior—

The humidity control system (10) of this embodiment also sequentially repeats, during a humidification operation, a first mode, a second mode and a third mode.

<First Mode>

In the humidity control system (10) during the first mode, the first adsorption heat exchanger (81) is intended for an adsorption action, the second adsorption heat exchanger (82) is intended for a regeneration action and the third adsorption heat exchanger (83) is intended for a cooling action.

In the refrigerant circuit (70) during the first mode, all the four-way selector valves (76, 77) are set to their first positions. In this state, refrigerant discharged from the compressor (71) passes through the second adsorption heat exchanger (82), the second expansion valve (74), the third adsorption heat exchanger (83), the first expansion valve (73) and the first adsorption heat exchanger (81) in this order and is then sucked into the compressor (71). In this case, in the refrigeration circuit (70), the second adsorption heat exchanger (82) serves as a condenser and the third and first adsorption heat exchangers (83, 81) serve as evaporators.

Furthermore, when the first expansion valve (73) is set to a full-open position, the third adsorption heat exchanger (83) has approximately the same refrigerant evaporation temperature as the first adsorption heat exchanger (81). When the first expansion valve (73) is set to a slightly closed position, the first adsorption heat exchanger (81) has a lower refrigerant evaporation temperature than the third adsorption heat exchanger (83).

In the first adsorption heat exchanger (81), moisture in the first air is adsorbed on the adsorbent. In the second adsorption heat exchanger (82), the second air is humidified by moisture desorbed from the adsorbent. In the third adsorption heat exchanger (83), the second air humidified by the second adsorption heat exchanger (82) is cooled.

<Second Mode>

In the humidity control system (10) during the second mode, the first adsorption heat exchanger (81) is intended for a cooling action, the second adsorption heat exchanger (82) is intended for an adsorption action and the third adsorption heat exchanger (83) is intended for an regeneration action.

In the refrigerant circuit (70) during the second mode, the first four-way selector valve (76) is set to its first position, the second four-way selector valve (77) is set to its second position and the first expansion valve (73) is set to a full-open position. In this state, refrigerant discharged from the compressor (71) passes through the first expansion valve (73), the third adsorption heat exchanger (83), the second expansion valve (74), the second adsorption heat exchanger (82) and the first adsorption heat exchanger (81) in this order and is then sucked into the compressor (71). In this case, in the refrigeration circuit (70), the third adsorption heat exchanger (83) serves as a condenser and the second and first adsorption heat exchangers (82, 81) serve as evaporators.

In the second adsorption heat exchanger (82), moisture in the first air is adsorbed on the adsorbent. In the third adsorption heat exchanger (83), the second air is humidified by moisture desorbed from the adsorbent. In the first adsorption heat exchanger (81), the second air humidified by the third adsorption heat exchanger (83) is cooled.

<Third Mode>

In the humidity control system (10) during the third mode, the first adsorption heat exchanger (81) is intended for an regeneration action, the second adsorption heat exchanger (82) is intended for a cooling action and the third adsorption heat exchanger (83) is intended for an adsorption action.

In the refrigerant circuit (70) during the third mode, the first four-way selector valve (76) is set to its second position and the second four-way selector valve (77) is set to its first position. In this state, refrigerant discharged from the compressor (71) passes through the first adsorption heat exchanger (81), the first expansion valve (73), the third adsorption heat exchanger (83), the second expansion valve (74) and the second adsorption heat exchanger (82) in this order and is then sucked into the compressor (71). In this case, in the refrigeration circuit (70), the first adsorption heat exchanger (81) serves as a condenser and the third and second adsorption heat exchangers (83, 82) serve as evaporators.

Furthermore, when the second expansion valve (74) is set to a full-open position, the third adsorption heat exchanger (83) has approximately the same refrigerant evaporation temperature as the second adsorption heat exchanger (82). When the second expansion valve (74) is set to a slightly closed position, the second adsorption heat exchanger (82) has a lower refrigerant evaporation temperature than the third adsorption heat exchanger (83).

In the third adsorption heat exchanger (83), moisture in the first air is adsorbed on the adsorbent. In the first adsorption heat exchanger (81), the second air is humidified by moisture desorbed from the adsorbent. In the second adsorption heat exchanger (82), the second air humidified by the first adsorption heat exchanger (81) is cooled.

Embodiment 3 of the Invention

A description is given of Embodiment 3 of the invention. This embodiment is directed to a humidity control system (10) for supplying humidity-controlled air to a room.

Figure 17:
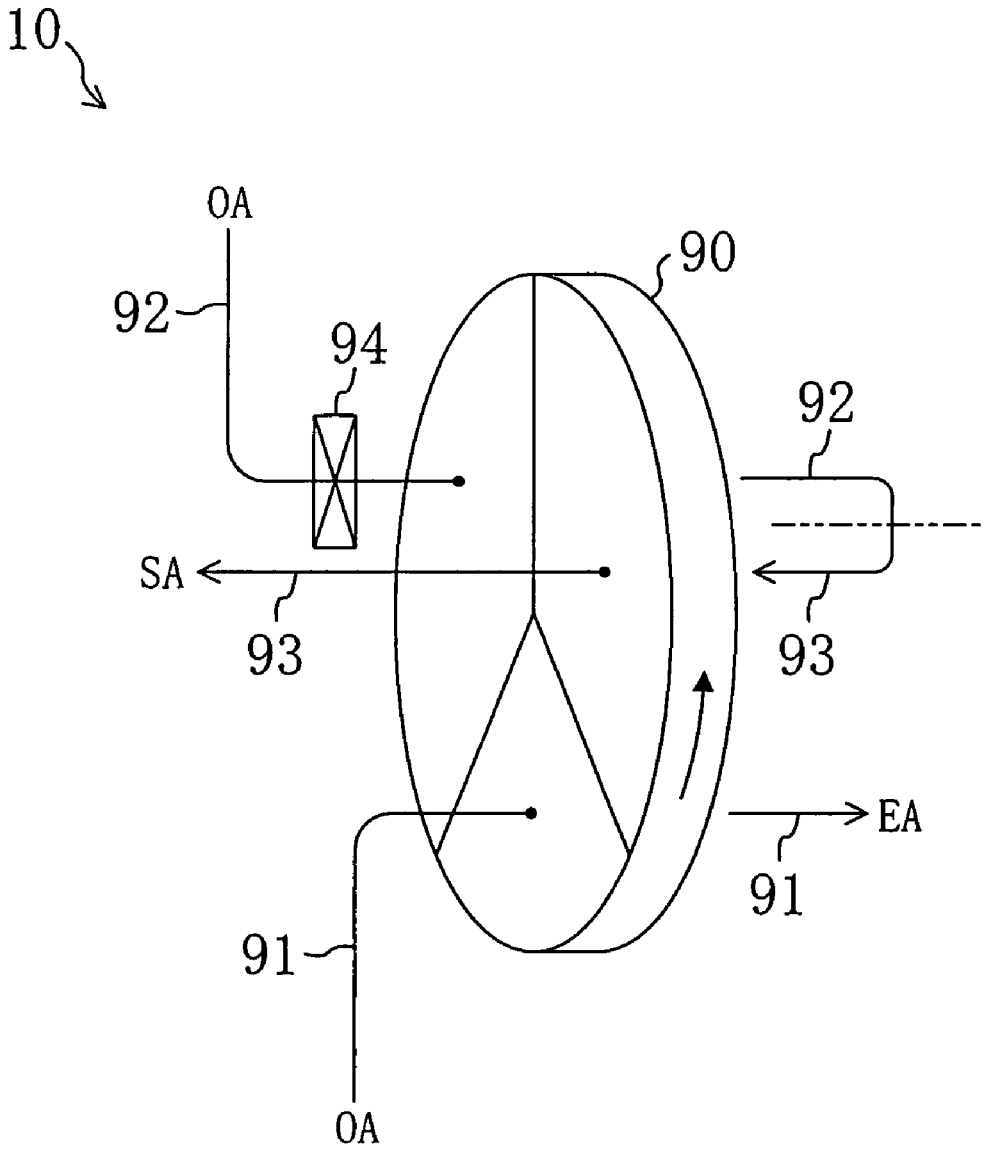
FIG. 17 is a schematic structural diagram of a humidity control system according to Embodiment 3.

As shown in FIG. 17, the humidity control system (10) of this embodiment includes a single adsorption rotor (90) as an adsorption element. Furthermore, the humidity control system (10) is provided with an adsorption side passage (91), a regeneration side passage (92) and a cooling side passage (93). The adsorption side passage (91) is communicated at its starting and terminal ends with the outside space. The regeneration side passage (92) is communicated at its starting end with the outside space and connected at its terminal end to the starting end of the cooling side passage (93). The terminal end of the cooling side passage (93) is communicated with a room space.

The adsorption rotor (90) is formed in a disc shape and allows air to pass through it in the direction of the thickness. The surface of the adsorption rotor (90) carries an adsorbent, such as zeolite. Air passing through the adsorption rotor (90) is brought into contact with the adsorbent. The adsorption rotor (90) is disposed across all of the adsorption side passage (91), the regeneration side passage (92) and the cooling side passage (93). The adsorption rotor (90) is divided into three sector regions: the first region going across the adsorption side passage (91); the second region going across the regeneration side passage (92); and the third region going across the cooling side passage (93). Furthermore, the adsorption rotor (90) is driven into rotation on its axis. When viewed in the direction of rotation of the adsorption rotor (90), the cooling side passage (93) is disposed adjacent the adsorption side passage (91), the regeneration side passage (92) is disposed adjacent the cooling side passage (93) and the adsorption side passage (91) is disposed adjacent the regeneration side passage (92).

The humidity control system (10) includes a heating heat exchanger (94) provided as a regenerator. The heating heat exchanger (94) is disposed in the regeneration side passage (92) upstream of the adsorption rotor (90). The heating heat exchanger (94) is connected to a hot water circuit, although not shown, through which hot water circulates. Furthermore, the heating heat exchanger (94) is configured to allow the hot water to exchange heat with air flowing through the regeneration side passage (92) towards the adsorption rotor (90), thereby heating the air.

—Operational Behavior—

In the humidity control system (10) during a humidification operation, the air outside a cold storage is taken as a first air into the adsorption side passage (91) and taken as a second air into the regeneration side passage (92).

The first air taken in the adsorption side passage (91) comes into contact with the adsorbent while passing through a part of the adsorption rotor (90) going across the adsorption side passage (91). As a result, moisture in the first air is adsorbed on the adsorbent. The first air, from which moisture has been taken by the adsorbent, flows through the adsorption side passage (91) and is then exhausted to the outside.

The second air taken in the regeneration side passage (92) is heated while passing through the heating heat exchanger (94). Then, the second air passes through a part of the adsorption rotor (90) going across the regeneration side passage (92). During the passage, the adsorbent of the adsorption rotor (90) comes into contact with the heated second air, so that moisture desorbed from the heated adsorbent is given to the second air. The second air heated during passage through the heating heat exchanger (94) and humidified during passage through the adsorption rotor (90) flows into the cooling side passage (93). On the other hand, the part of the adsorption rotor (90) in which the adsorbent has been regenerated during passage of the second air through the regeneration side passage (92) moves to the adsorption side passage (91) with the rotation of the adsorption rotor (90).

As described above, the second air flows from the regeneration side passage (92) into the cooling side passage (93). Furthermore, the part of the adsorption rotor (90) having adsorbed moisture during passage through the adsorption side passage (91) moves to the cooling side passage (93) with the rotation of the adsorption rotor (90). The second air flowing through the cooling side passage (93) passes through the part of the adsorption rotor (90) going across the cooling side passage (93). The part of the adsorption rotor (90) going across the cooling side passage (93) has a lower temperature than the part thereof going across the regeneration side passage (92) and has already adsorbed a relatively large amount of moisture while having gone across the adsorption side passage (91). Therefore, while the second air passes through the part of the adsorption rotor (90) going across the cooling side passage (93), only heat is taken from the second air by the adsorption rotor (90) but little or no moisture is taken from the second air.

—Effects of Embodiment 3—

According to the humidity control system (10) of this embodiment, the second air given moisture and heat while flowing through the regeneration side passage (92) is sent to the cooling passage (93) to which moves the part of the adsorption rotor (90) having adsorbed moisture while having gone across the adsorption side passage (91), thereby allowing the second air to pass through the part of the adsorption rotor (90) going across the cooling side passage (93). Therefore, by using the part of the adsorption rotor (90) having already adsorbed moisture, only heat can be taken from the second air given moisture and heat. Hence, according to this embodiment, the temperature of the second air supplied to the room by the humidity control system (10) during the humidification operation can be reduced as compared with the conventional cases where the air supplied with moisture and heat is supplied to the room as its is. This restrains the increase in the cooling load in the cold storage into which the humidity control system (10) supplies the second air.

Other Embodiments

The humidity control systems (10) of Embodiments 1 and 2 may be additionally provided with a sensible heat exchanger. The sensible heat exchanger allows heat exchange between an in-storage air just after taken in as a first air and a humidified and cooled second air just before supplied to the cold storage. If such a sensible heat exchanger is additionally provided, the in-storage air to be exhausted from the cold storage for the purpose of ventilation can also be utilized to cool the second air.

Note that the above embodiments are merely illustrative in nature and are not intended to limit the scope, applications and use of the invention.

INDUSTRIAL APPLICABILITY

As seen from the above description, the invention is useful for a humidity control system for controlling the air humidity.

The invention claimed is:

1. A humidity control system comprising a plurality of adsorption elements allowing respective adsorbents carried on the respective surfaces thereof to come into contact with air and a regenerator for regenerating the adsorbents of the adsorption elements by heating, the humidity control system being configured to allow each said adsorption element to repeatedly perform an adsorption action of adsorbing moisture in a first air on the associated adsorbent and a regeneration action of regenerating the adsorbent with the regenerator to humidify a second air, the humidity control system being capable of a humidification operation of supplying the humidified second air to a room and exhausting the dehumidified first air to the outside, the humidity control system performing, during the humidification operation, a cooling action of cooling the second air humidified by one said adsorption element performing the regeneration action by allowing the second air to pass through another said adsorption element having already performed the previous adsorption action but having not yet performed the next regeneration action.

2. A humidity control system comprising first, second and third adsorption elements allowing respective adsorbents carried on the respective surfaces thereof to come into contact with air and a regenerator for regenerating the adsorbents of the adsorption elements by heating, the humidity control system being configured to sequentially repeat:

a first mode in which moisture in a first air is adsorbed on the first adsorption element and a second air humidified by the second adsorption element being regenerated by the regenerator is cooled by the third adsorption element;

a second mode in which moisture in the first air is adsorbed on the second adsorption element and the second air humidified by the third adsorption element being regenerated by the regenerator is cooled by the first adsorption element; and a third mode in which moisture in the first air is adsorbed on the third adsorption element and the second air humidified by the first adsorption element being regenerated by the regenerator is cooled by the second adsorption element, the humidity control system being capable of a humidification operation of supplying the humidified and cooled second air to a room and exhausting the dehumidified first air to the outside.

3. The humidity control system of claim 2, wherein adsorption heat exchangers allowing heat exchange of air passing therethrough with a heat transfer medium and carrying adsorbents on the surfaces thereof in contact with the air are provided as the adsorption elements, and a heat transfer medium circuit for supplying the heat transfer medium for heating to the second adsorption heat exchanger in the first mode, the third adsorption heat exchanger in the second mode and the first adsorption heat exchanger in the third mode is provided as the regenerator.

4. The humidity control system of claim 3, wherein the heat transfer medium circuit is configured to supply the heat transfer medium for cooling to the first and third adsorption heat exchangers in the first mode, the first and second adsorption heat exchangers in the second mode and the second and third adsorption heat exchangers in the third mode.

5. The humidity control system of claim 4, wherein the heat transfer medium circuit includes a compressor and an expansion mechanism and is configured to operate in a refrigeration cycle by circulating refrigerant as the heat transfer medium therethrough and supply the refrigerant of high pressure discharged from the compressor as the heat transfer medium for heating and the refrigerant of low pressure having passed through the expansion mechanism as the heat transfer medium for cooling to the associated adsorption heat exchangers.

6. A humidity control system comprising:

an adsorption side passage through which a first air to be dehumidified flows;

a regeneration side passage through which a second air to be humidified flows;

a cooling side passage which continues to the terminal end of the regeneration side passage and through which the second air flows;

an adsorption element disposed across the adsorption side passage, the regeneration side passage and the cooling side passage and allowing an adsorbent carried on the surface thereof to come into contact with air; and a regenerator for regenerating the adsorbent in a part of the adsorption element going across the regeneration side passage by heating, the humidity control system being capable of a humidification operation of moving the adsorption element so that a part of the adsorption element going across the adsorption side passage sequentially goes across the cooling side passage and the regeneration side passage and then returns to the adsorption side passage, supplying the second air humidified during passage through the adsorption element in the regeneration side passage and then cooled during passage through the adsorption element in the cooling side passage to a room, and exhausting the first air dehumidified during passage through the adsorption element in the adsorption side passage to the outside.

* * * * *